US008540343B2

(12) United States Patent
Kachi

(10) Patent No.: US 8,540,343 B2
(45) Date of Patent: Sep. 24, 2013

(54) IMAGE FORMING APPARATUS

(75) Inventor: Yasuhiko Kachi, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 45 days.

(21) Appl. No.: 13/246,531

(22) Filed: Sep. 27, 2011

(65) Prior Publication Data

US 2012/0075382 A1 Mar. 29, 2012

(30) Foreign Application Priority Data

Sep. 28, 2010 (JP) ..... 2010-217384

(51) Int. Cl.
*B41J 23/00* (2006.01)

(52) U.S. Cl.
USPC ..... 347/37

(58) Field of Classification Search
USPC ..... 347/37
See application file for complete search history.

(56) References Cited

U.S. PATENT DOCUMENTS

| | | | | |
|---|---|---|---|---|
| 5,488,396 | A * | 1/1996 | Burke et al. | 347/37 |
| 6,231,158 | B1 * | 5/2001 | Hiyane et al. | 347/37 |
| 7,562,975 | B2 * | 7/2009 | Yokoyama et al. | 347/104 |
| 2005/0093921 | A1 * | 5/2005 | Kumagai et al. | 347/37 |

FOREIGN PATENT DOCUMENTS

| | | | |
|---|---|---|---|
| JP | 04-110154 | * | 4/1992 |
| JP | 4-110154 | A | 4/1992 |
| JP | 2005-138371 | A | 6/2005 |
| JP | 2009-292044 | A | 12/2009 |

* cited by examiner

*Primary Examiner* — Matthew Luu
*Assistant Examiner* — Michael Konczal
(74) *Attorney, Agent, or Firm* — Birch, Stewart, Kolasch & Birch, LLP

(57) ABSTRACT

An image forming apparatus which includes a line head having a nozzle group in a two-dimensional matrix configuration, or a line head in which a plurality of head modules are joined together in a staggered matrix arrangement.

20 Claims, 32 Drawing Sheets

IMAGE FORMING APPARATUS

BACKGROUND OF THE INVENTION

1. Field of the Invention

The present invention relates to an image forming apparatus, and more particularly to technology for improving image quality produced by an image forming apparatus based on an inkjet method which is equipped with a line head having a nozzle group in a two-dimensional matrix configuration, or a line head in which a plurality of head modules are joined together in a staggered matrix arrangement.

2. Description of the Related Art

Known image recording methods for an inkjet recording apparatus include a serial method (multi-pass method) which records an image while moving a recording head back and forth reciprocally in a direction perpendicular to the paper conveyance direction, and a line method (single-pass method) in which a long line head is arranged in the paper width direction which is perpendicular to the paper conveyance direction and an image is recorded by one image recording pass by the line head.

Japanese Patent Application Publication No. 4-110154 discloses a composition in which a hole or a projection is provided in both end portions of a paper conveyance device, as a device for positioning and securing a recording head accurately with respect to a paper conveyance device, and the position of the conveyance device in the axial direction (horizontal direction) is restricted by providing projections or holes in the line head side.

Japanese Patent Application Publication No. 2005-138371 discloses a composition in which a position restricting carriage pin is provided in a carriage on which a group of a plurality of ink heads is mounted, and a positioning pin is provided in a belt platen which supports an endless belt that conveys paper, whereby the positional relationship therebetween is restricted due to the carriage pin fitting into the positioning hole.

Japanese Patent Application Publication No. 2009-292044 proposes positioning a recording head unit in which a plurality of recording heads are arranged and secured with respect to a paper conveyance unit, by means of pins and pin holes, in addition to which the recording head unit is fixed in an integrated fashion to the conveyance unit by gripping the pins which have been inserted into the pin holes, by means of a collet chuck. It is stated that, according to a composition of this kind, even if the apparatus is affected by vibration during operation of the printer, the conveyance unit and the head unit perform exactly the same vibration, and therefore the accuracy of the depositing positions is maintained (Paragraph 0041 in Japanese Patent Application Publication No. 2009-292044).

In each of Japanese Patent Application Publication No. 4-110154, Japanese Patent Application Publication No. 2005-138371 and Japanese Patent Application Publication No. 2009-292044, the ink deposition accuracy may decline due to relative vibration between the line head and the paper, and there is a possibility that the image formation lines (raster lines) in the paper conveyance direction are skewed. The amount of skew (amplitude) which is perceived as a problem in these related art technologies is based on a vibration level of the order of several tens of μm.

However, apart from the technical problems described in Japanese Patent Application Publication No. 4-110154, Japanese Patent Application Publication No. 2005-138371 and Japanese Patent Application Publication No. 2009-292044, a line head having a nozzle group in a two-dimensional arrangement or a line head formed by joining together a plurality of head modules in a staggered matrix configuration also involves problems of the following kinds.

DESCRIPTION OF TECHNICAL PROBLEM

Here, a two-dimensional nozzle is described as an example, taking the paper conveyance direction as the y direction, and the paper width direction which is perpendicular to the conveyance direction (y direction) as the x direction. A two-dimensional nozzle arrangement is described in a line head which is capable of recording over the whole of the x direction image formation range of the paper (also known as a page-wide head or a full-line type head). In a head having a two-dimensional nozzle arrangement, of the pairs of nozzles which form dots that are mutually adjacent in the x direction on the paper (or a raster created by linking dots continuously in the y direction), there are nozzle pairs which are in a positional relationship separated by a distance in the y direction, in terms of the layout of nozzles in the head (such nozzles are also called a "y-offset adjacent nozzle pair" below).

In this case, if there is relative vibration in the x direction between the head and the paper, then the pitch between the rasters recorded by the y-offset adjacent nozzle pair varies depending on the relative vibration. As a result of this, a "weighting (overlapping)" or "gap" appears between the dots (between adjacent dots in the x direction) which are recorded by the y-offset adjacent nozzle pair, and the extent of this "weighting" or "gap" changes in the y direction, producing a non-uniformity which degrades the image quality.

In the present specification, density non-uniformity which is caused by relative vibration or displacement in the x direction between the paper and a head in this way is called "vibration non-uniformity".

A phenomenon of this kind is described here by means of the examples in FIG. 29 to FIG. 34. FIG. 29 is one example of a two-dimensional nozzle arrangement. A black dot "•" in FIG. 29 indicates a nozzle position. The horizontal axis represents a position in the x direction and the vertical axis represents a position in the y direction; a nozzle position is represented by coordinates in pixel (pix) units which are determined by the recording resolution.

As shown in FIG. 29, this two-dimensional nozzle layout has two nozzle rows separated in the y direction, and within the same row, nozzles are arranged every other 1 pix (i.e. the x-direction nozzle pitch within one row is 2 pix) and the positions of the nozzles belonging to different rows are staggered by 1 pix in the x direction with respect to each other (a so-called staggered matrix configuration). As a result of this, an image formation mode is adopted in which, a raster (scanning line) is formed on the paper every other 1 pix by the nozzle group belonging to the first row, and rasters formed by the nozzle group of the second row are embedded between the rasters formed by the nozzles of the first row. The pitch in the y direction between the first and second rows is called the offset amount of the "y-offset adjacent nozzle pair" (y-direction offset amount). Here, an example is given in which the y-direction offset amount is 500 pix. If the image formation resolution is 1200 dpi, then 500 pix represents 10.6 mm.

FIG. 30 shows one example of rasters drawn by respective nozzles in a case where there is relative vibration in the x direction between a head and paper, in a head having a two-dimensional nozzle arrangement as shown in FIG. 29. FIG. 30 shows a group of rasters obtained when ejection is started simultaneously from all of the nozzles and continuous ejection is performed at a prescribed droplet ejection frequency while conveying the paper at a uniform speed in the y direction. Furthermore, FIG. 31 shows an example of an image actually formed on paper in this case (a solid image; droplet ejection rate 100%). FIG. 30 and FIG. 31 are examples of a case where the single amplitude of the relative vibration in the x direction is 5 μm, and the period of the relative vibration is 1000 pix=21.2 mm when converted to a spatial distance on the paper in the y direction.

In FIG. 30, the raster indicated by reference numeral 1A is drawn by nozzles belonging to the lower row (first row) in FIG. 29. In FIG. 30, the raster indicated by reference numeral 2B is drawn by nozzles belonging to the upper row (second row) in FIG. 29. The raster 1A and the raster 2B are separated by the equivalent of 500 pix in the y direction. This corresponds to the y-direction offset amount between the lower row nozzle and the upper row nozzle in FIG. 30.

Supposing that there is no relative vibration in the x direction between the head and the paper, then the scanning lines (rasters) of the y-offset adjacent nozzle pair are straight lines which extend in perfectly straight fashion in the y direction, and the pitch between the rasters is a uniform value determined by the resolution (for example, a pitch of about 21.2 μm in the case of 1200 dpi resolution).

On the other hand, if there is relative vibration in the x direction between the head and the paper, then the raster of a nozzle of the first row (reference numeral 1A) and the raster of a nozzle of the second row (reference numeral 2B) each fluctuate (see FIG. 30). This fluctuation of the rasters causes variation in the spatial period of the x-direction pitch between mutually adjacent rasters (1A, 2B), depending on the position in the paper conveyance direction (y direction).

As a result of this, as shown in FIG. 31, periodic non-uniformity occurs in the resulting image that is formed. More specifically, since the x-direction pitch between rasters which are mutually adjacent in the x direction varies periodically, then a "weighting" of the adjacent rasters (mutual approach of the rasters) and a "gap" in the adjacent rasters (distancing of the rasters) is repeated in the y direction, and this appears as a density non-uniformity in the image formation results on the paper.

In FIG. 31, a white-striped region 4 in which white stripes extending in the y direction are arranged roughly equidistantly in the x direction, and a black region 5 where the white stripes are interrupted and appear darker (more dense) in the y direction are repeated at ½ of the period of the vibration in the y direction (here, 500 pix).

Looking across the white-striped region 4 in the x direction, a portion where there is a white gap (white stripe) and a portion where there is no white stripe (black portion) are repeated alternately. If the white-striped portions are viewed in further detail, the gaps of white stripes (the thickness of the white stripes) are not uniform in the y direction, but rather become larger in the central portion. If the white-striped region 4 of this kind is viewed macroscopically, the density is reduced compared to the black region 5, and therefore when the image is viewed as a whole, a density non-uniformity is visible in which the density varies in the y direction (dark/light shading is repeated periodically), and therefore image quality declines.

In the description above, an example is given in which nozzles are arranged two-dimensionally in two rows (y column) by N columns (x direction, where N is an integer and N≥2), but the present problem is not limited to this nozzle arrangement and a similar problem occurs in other two-dimensional nozzle arrangements (for example, an M row×N column two-dimensional nozzle arrangement, where M is an integer and M≥2).

FIG. 32 shows a case of a nozzle layout having six rows by N columns. Similarly to FIG. 29, if the single amplitude of the relative vibration is 5 μm, then the period of the relative vibration is 1000 pix=21.2 mm in terms of a y-direction distance on the paper. FIG. 33 shows one example of rasters in a case where there is relative vibration in the x direction between the head and the paper, in a head having the nozzle arrangement in FIG. 32, and FIG. 34 is an example of an image (solid image) formed in this case.

In the case of the nozzle arrangement shown in FIG. 32, there are a total of six combinations of nozzle rows having nozzles which constitute y-offset adjacent nozzle pairs: the first row and second row, the second row and third row, the third row and fourth row, the fourth row and fifth row, the fifth row and sixth row, and the sixth row and first row. Density non-uniformity occurs due to variation in the pitch between the rasters corresponding to these respective nozzles (see FIG. 34), and of this non-uniformity, the white stripes caused by variation in the pitch between rasters formed by the pair of nozzles which are spaced furthest apart in the y direction (namely, the nozzles of the sixth row and the nozzles of the first row) is most conspicuous and this nozzle pair which have the largest offset amount have the greatest effect on image deterioration.

In this case, as shown in FIG. 34, the white-striped region 6 and the black region 7 are repeated at a vibration period (here, 1000 pix) in the y direction. In FIG. 31 and FIG. 34, the period of the vibration non-uniformity (white-striped region and black region) varies due to the following reason.

The nozzle arrangement related to FIG. 31 is an alignment of two rows as shown in FIG. 29. In this case, there are two sets of "y-offset adjacent nozzle pairs", namely, a set of "first row nozzle-second row nozzle" (hereinafter called "A set") and a set of "second row nozzle-first row nozzle" (hereinafter called "B set"). A vibration non-uniformity having a vibration period (1000 pix) occurs in the A set nozzle pair and a vibration non-uniformity having a vibration period (1000 pix) occurs also in the B set nozzle pair. Since the vibration non-uniformities created by the two sets of nozzle pairs are mutually displaced by 180 degrees, then the synthesized vibration non-uniformity has a period of ½ of the vibration period (500 pix) (see FIG. 30).

On the other hand, the case shown in FIG. 34 corresponds to the nozzle arrangement indicated in FIG. 32 (a six-row arrangement), but in this case, the "y-offset adjacent nozzle pair" is formed by only one set: "sixth row nozzle-first row nozzle", and the period of the vibration non-uniformity which appears is the vibration period (1000 pix) only (see FIG. 33).

There are also cases where the positions of an adjacent nozzle pair which have a y-direction offset amount greater than other y-offset adjacent nozzle pairs span a nozzle joint section in the two-dimensional matrix configuration, as in the relationship between the nozzles in the sixth row and the nozzles in the first row illustrated in FIG. 32.

The problems of vibration non-uniformities as described above are not limited to joint sections in a two-dimensional matrix configuration, and also occur similarly in joint sections between modules in a line head in which head modules having a single-row nozzle array (one-dimensional nozzle arrangement) are arranged in a staggered configuration (see FIG. 28), or a line head where head modules having a two-dimensional matrix arrangement are joined together in a staggered configuration (see FIG. 27).

In the case of a composition in which modules having a two-dimensional matrix configuration are arranged in a staggered matrix, both the nozzle joint sections of the matrix in the modules and the nozzle joint sections between the modules (module joint sections) may give rise to problems. In the present specification, in order to simplify the explanation, the term "nozzle joint section" is used to cover both nozzle joint sections in a matrix arrangement and module joint sections. In other words, the problem to be resolved by the present invention relates to dark/light non-uniformities (bead uniformities) caused by phase differences in the image formation lines (rasters) which occur depending on the spatial distance in the paper conveyance direction between two nozzles which are positions in a nozzle joint section of a two-dimensional matrix arrangement of a line head, or in a nozzle joint section between head modules arranged in a staggered configuration (this spatial distance being called the "y-direction offset amount") and the relative vibration frequency.

In particular, there is a problem of dark/light shading non-uniformities which are most visible when the oscillation in the image formation direction (skew pitch) which is determined by the relative vibration frequency in the x direction and the relative velocity between the line head and the recording medium (conveyance speed of the recording medium), and the spatial distance of the nozzle joint section are synchronized in opposite phases.

This problem differs from the problems described in Japanese Patent Application Publication No. 4-110154, Japanese Patent Application Publication No. 2005-138371 and Japanese Patent Application Publication No. 2009-292044 in that it depends on the spatial distance pitch of the nozzle joint sections and the relative vibration frequency, and also differs greatly from the problems of the related art in that dark/light shading of the present problem is visible at a smaller vibration amplitude level (a level of around 4 μm) than in the problems of the related art.

SUMMARY OF THE INVENTION

The present invention has been contrived in view of these circumstances, an object thereof being to provide an image forming apparatus capable of reducing deterioration in image quality resulting from density non-uniformities (vibration non-uniformities) caused by the y-direction spatial distance of nozzle joint sections in a nozzle arrangement of a liquid ejection head and by relative vibration between liquid ejection head and the image formation medium (recording paper, or the like).

The following modes of the invention are provided in order to achieve the aforementioned object.

In order to attain an object described above, one aspect of the present invention is directed to an image forming apparatus comprising: a liquid ejection head having an ejection surface in which a plurality of nozzles that eject liquid droplets are arranged two-dimensionally, or a liquid ejection head in which a plurality of head modules each having a plurality of nozzles that eject liquid droplets are arranged in a staggered configuration; a conveyance device which conveys a recording medium on which the liquid droplets ejected from the plurality of nozzles of the liquid ejection head are deposited; a main body frame which supports the conveyance device; a head movement device which supports the liquid ejection head movably with respect to the main body frame; and a head fixing device which fixes the movable liquid ejection head to the main body frame at a position for droplet ejection onto the recording medium, wherein: the head fixing device has a pressure application device for head fixing which impels the liquid ejection head in a width direction of the recording medium which is perpendicular to a conveyance direction in which the conveyance device conveys the recording medium, and a resonance frequency which is determined by a spring constant of the pressure application device for head fixing and a mass of the liquid ejection head is different from a frequency component of a vibration pitch which is dependent on a spatial distance in the conveyance direction between a pair of nozzles which correspond to a joint section of a nozzle alignment forming adjacent dots in the width direction on the recording medium, of distances between nozzles in the conveyance direction in nozzle arrangement of the liquid ejection head, a relative vibration frequency in the width direction between the conveyance device and the liquid ejection head during conveyance of the recording medium, and a conveyance speed at which the conveyance device conveys the recording medium.

According to this aspect of the invention, when a liquid ejection head which is movable by means of a head movement device is fixed in a liquid ejection position, pressure is applied to the liquid ejection head by the pressure application device for head fixing and the head is fixed in a state of abutting against the main body frame. The liquid ejection head which is fixed by application of pressure by the pressure application device for head fixing has a resonance frequency f1 (resonance point) which is determined by the spring constant k1 of the pressure application device for head fixing and the mass m1 of the liquid ejection head.

In this aspect of the invention, the apparatus is composed in such a manner that the resonance frequency f1 is not synchronized with the frequency component of the vibration pitch. By this means, the frequency components which are synchronized with the frequency component of the vibration pitch are reduced, and the visibility of the vibration non-uniformity is suppressed.

"Vibration pitch" means the spatial period of the dark/light non-uniformity (vibration non-uniformity) which appears in the y direction on the recording medium when the recording medium is conveyed at a uniform speed, and the frequency of generation of the vibration non-uniformity which is determined by the spatial period and the recording medium conveyance speed corresponds to the "frequency component of the vibration pitch".

It is possible to use an elastic member, such as a plate spring, a coil spring, an elastic body, or the like, as the pressure application device for head fixing.

Furthermore, this aspect of the present invention is able to reduce the relative vibrational difference between the liquid ejection head and the conveyance device, by fixing the liquid ejection head to the main body frame which supports the conveyance device. It is possible effectively to suppress density non-uniformity (vibration non-uniformity), in combination with reduction in the frequency components described above.

Desirably, the image forming apparatus further comprises: an elevator device which moves the liquid ejection head to the position for droplet ejection where the liquid ejection head is moved closely to the conveyance device, and to a withdrawn position where the liquid ejection head is moved further away from the conveyance device than in the position for droplet ejection; and a cam mechanism which pushes the liquid ejection head in the width direction in coordination with a movement of the liquid ejection head to be closer to the conveyance device by the elevator device, and which releases pushing of the liquid ejection head in the width direction in coordination with a movement of the liquid ejection head to be away from the position for droplet ejection by the elevator device.

According to this aspect of the invention, when the liquid ejection head is moved to close proximity with the conveyance device by the elevator device, the liquid ejection head is pressed against the main body frame by the cam mechanism which is coordinated with this approach movement. By means of this action, pressure is applied between the liquid ejection head and the main body frame, from the pressure application device for head fixing, and the liquid ejection head is fixed (constricted).

Desirably, the cam mechanism includes: an inclined cam surface provided on a side surface section of the liquid ejection head; and a rotating body which is provided on the main body frame and which is able to perform following rotation while abutting against the inclined cam surface.

According to this aspect of the invention, in accordance with the approach movement of the liquid ejection head by the elevator device, the liquid ejection head can be pressed and moved gradually while the rotating body abuts against the inclined cam surface, and therefore the head can be fixed smoothly. It is possible to use a roller, a bearing, or the like, for example, as the rotating body.

Desirably, a drum or roller is used as the conveyance device, and the image forming apparatus further comprises a conveyance unit fixing device which applies pressure in an axial direction of the drum or roller in such a manner that the drum or roller is fixed to the main body frame.

According to this aspect of the invention, the conveyance device which comprises a drum or a roller is fixed in an integrated fashion to the main body frame by means of a conveyance unit fixing device. Furthermore, by fixing the liquid ejection head in the droplet ejection position by applying pressure by means of a pressure application device, a structure is obtained in which the conveyance device and the liquid ejection head are connected in an integrated fashion to the main body frame. By this means, it is possible to synchronize the vibration transmitted to the conveyance device and the vibration transmitted to the liquid ejection head, and reduction in the deposition accuracy as a result of vibration can be suppressed effectively.

Desirably, the conveyance unit fixing device has a pressure application device for conveyance unit fixing which impels the drum or roller towards the main body frame in the axial direction.

By adopting a composition in which a drum or a roller is fixed by applying pressure in the axial direction between the rotating axle of a drum or a roller and the main body frame which supports same, it is possible to reduce even further any relative vibrational difference between the liquid ejection head and the conveyance device (drum or roller).

Desirably, a resonance frequency which is determined by a spring constant of the pressure application device for conveyance unit fixing and a mass of the drum or roller is different from the frequency component of the vibration pitch.

According to this aspect of the invention, pressure is applied to the drum or roller which functions as a conveyance device, by the pressure application device for conveyance unit fixing, and the drum or roller is thereby fixed in an abutted state against the main body frame. The drum or roller which is fixed by application of pressure by the pressure application device for conveyance unit fixing has a resonance frequency f2 (resonance point) which is determined by the spring constant k2 of the pressure application device for conveyance unit fixing and the mass m2 of the drum or roller.

In this aspect of the invention, the apparatus is composed in such a manner that the resonance frequency f2 is not synchronized with the frequency component of the vibration pitch. By this means, the frequency components which are synchronized with the frequency component of the vibration pitch are reduced, and the visibility of the vibration non-uniformity is suppressed yet further.

Desirably, the head movement device includes: a carriage which is provided movably with respect to the main body frame; a mounting platform which is provided on the carriage and on which the liquid ejection head is mounted; and a guide rail installed on the main body frame, wherein: the carriage is movably guided along the guide rail in such a manner that the liquid ejection head is able to be moved between a first position where the conveyance device is opposed to the liquid ejection head and a second position outside a conveyance region where the recording medium is conveyed by the conveyance device, and the image forming apparatus further comprises a carriage fixing device which fixes the carriage to the main body frame in the first position.

According to this aspect of the invention, the liquid ejection head is mounted on a carriage, and the carriage is provided movably with respect to the main body frame via a guide rail. The carriage is fixed to the main body frame by a carriage fixing device in a first position where the liquid ejection head faces the conveyance device. By this means, the carriage and the liquid ejection head can be coupled and fixed in an integrated fashion, to the main body frame, and relative vibration difference between the liquid ejection head and the conveyance device can be reduced.

It is possible to adopt a mode in which a plurality of mounting platforms are provided on the carriage, whereby a plurality of liquid ejection heads (for example, recording heads corresponding to ink colors of C (cyan), M (magenta), Y (yellow) and K (black)) can be mounted on a common carriage. In this case, a desirable mode is one where elevator devices are provided for the heads respectively and a composition is adopted in which each of the heads can be moved between a liquid droplet ejection position and a withdrawn position.

Desirably, an electromagnet and a fixed member which is magnetically attached to the electromagnet are used as the carriage fixing device, and one of the electromagnet and the fixed member is provided on the main body frame and the other one of the electromagnet and the fixed member is provided on the carriage.

According to this aspect of the invention, it is possible to lock or unlock (release locking) of the movable carriage with respect to the main body frame in a simple manner.

Desirably, the image forming apparatus further comprises a maintenance device which performs maintenance of the liquid ejection head at the second position.

According to this aspect of the invention, it is possible to withdraw the liquid ejection head to a region outside the conveyance path of the recording medium (a second position), in order to carry out maintenance of the liquid ejection head. The maintenance operation involves, for example, nozzle surface wiping, purging (preliminary ejection), nozzle suctioning, or a suitable combination of these. For the maintenance device, it is possible to employ, for example, a wiping device which wipes the nozzle surface (a mode using a web, a mode using a blade, or a mode using a combination of these), a liquid receptacle section for receiving liquid from purging (preliminary ejection), a suction cap for nozzle suctioning, a suction pump, or a suitable combination of these.

Desirably, the liquid ejection head is a line head which is long in the width direction of the recording medium, and image formation based on a single pass method is carried out in such a manner that an image is formed on the recording medium by causing just one relative movement in the conveyance direction between the recording medium and the liquid ejection head.

The problem of vibration non-uniformity may be a particular problem in a single-pass type image forming apparatus which uses a line head, and therefore the application of the present invention is effective as a countermeasure to this. According to this aspect of the invention, it is possible to achieve both high image formation quality and high productivity.

According to the present invention, it is possible effectively to reduce the visibility of dark/light non-uniformity (vibration non-uniformity) which results from relative vibration of the conveyance device and the liquid ejection head and the nozzle arrangement of the liquid ejection head. Therefore, it is possible to achieve high image formation quality and high productivity.

BRIEF DESCRIPTION OF THE DRAWINGS

A preferred embodiment of this invention as well as other objects and benefits thereof, will be explained in the following with reference to the accompanying drawings, in which like reference characters designate the same or similar parts throughout the figures and wherein.

DETAILED DESCRIPTION OF THE PREFERRED EMBODIMENTS (1) Causes of Vibration Non-Uniformity Firstly, the causes of the occurrence of vibration non-uniformity will be described. There are the following two main causes of vibration non-uniformity.

(1-a) Causes of x Direction Relative Vibration (Main Cause)

There are components and parts in an inkjet recording apparatus which vibrate at intrinsic frequencies. Examples of this vibration are: intrinsic vibration of the head unit, intrinsic vibration of the supporting frame (side plate) which holds the paper conveyance drum, intrinsic vibration of the belt which transmits the rotation of the motor to the pulleys, vibration of the vacuum pump used for suctioning the paper onto the drum, and the like.

These sources of vibration vibrate at a frequency which is intrinsic to the source of vibration (member), and vibrate in this fashion at the same frequency, even if the conveyance speed of the paper (corresponding to the "relative scanning speed") changes. In other words, they are vibration sources which vibrate at a fixed frequency which is independent of the relative scanning speed.

When the vibration frequency of a vibration source which vibrates at a fixed frequency in this way is represented by fv, then the period Pv of the vibration appearing on the paper (the length in the y direction on the paper, in other words, the vibration as expressed as a spatial period) is expressed as follows, if the conveyance speed of the paper is represented by vp.

$$Pv=vp/fv \qquad \text{Formula 1}$$

In other words, if a vibration source oscillates at an intrinsic frequency (fv) irrespective of the conveyance speed, then the period Pv (y-direction pitch) of the vibration appearing on the paper as a result of this oscillation varies depending on the conveyance speed (vp). If the conveyance speed (vp) is fast, then the period (Pv) of the vibration appearing on the paper is long. Conversely, the slower the conveyance speed (vp), the shorter the period (Pv) (the finer the pitch) of the vibration appearing on the paper.

(1-b) Relationship Between x-Direction Vibration Period and Nozzle Arrangement (Sub-Factor)

The extent of the x-direction pitch variation AD(y) between two scanning lines (rasters) recorded by a "y-offset adjacent nozzle pair" changes depending on the relationship between the y-direction offset amount (which is equivalent to the "offset distance") OSy between the "y-offset adjacent nozzle pair" arising from the nozzle arrangement in the head, and the period Pv of the x-direction relative vibration on the paper (Pv being determined from Formula 1 on the basis of the fixed vibration frequency fv and the relative scanning speed vp).

Figure 1:
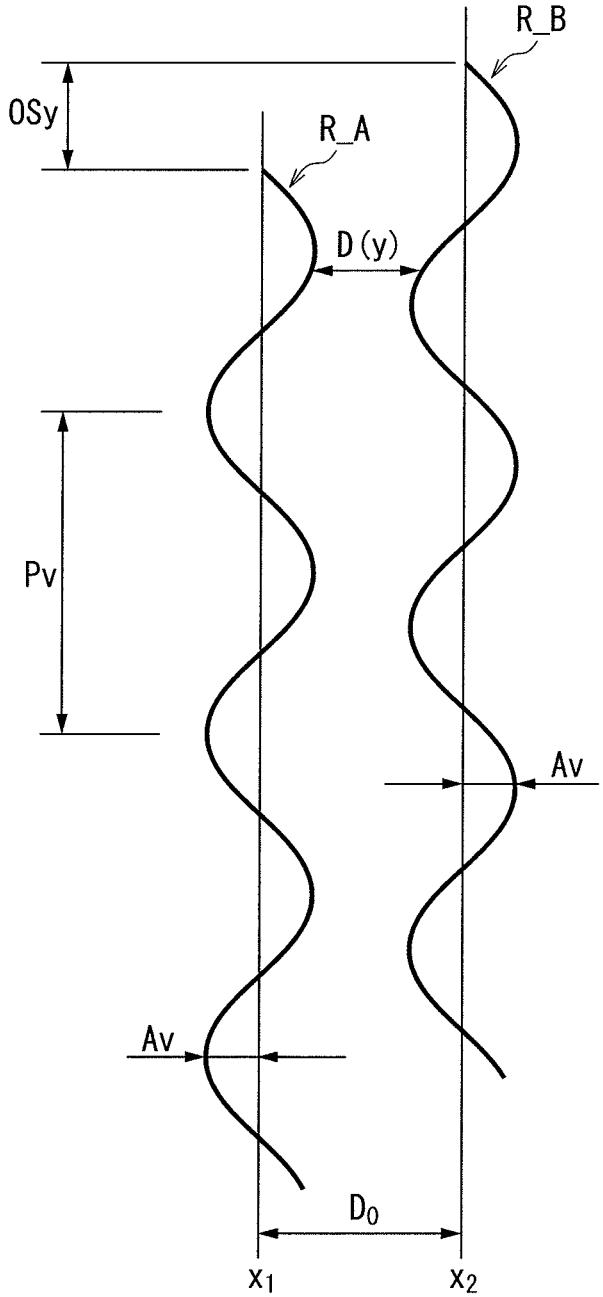
FIG. 1 is an illustrative diagram showing a schematic view of rasters in a paper conveyance direction which are recorded by a y-offset adjacent nozzle pair.

FIG. 1 shows an enlarged schematic view of rasters (scanning lines) in the paper conveyance direction which are recorded by a y-offset adjacent nozzle pair. For the sake of simplicity, in the illustration in FIG. 1, the longitudinal/lateral dimensional ratio is distorted (deformed) in order to emphasize the amount of fluctuation of the rasters.

The horizontal direction in FIG. 1 is the lengthwise direction of the long inkjet head (bar) (called the "x direction"), and the vertical direction is called the paper conveyance direction (direction of relative movement of the head and the paper, called the "y direction"). The line R_A having the waveform shown on the left-hand side in FIG. 1 indicates a raster produced by one nozzle of a y-offset adjacent nozzle pair (called "nozzle A" here), and the line R_B having the waveform shown on the right-hand side of FIG. 1 indicates a raster produced by the other nozzle of the pair (called "nozzle B" here). Rasters are recorded by dot rows created by a continuous sequence of dots formed by liquid droplets which are deposited on paper by performing continuous droplet ejection at a uniform cycle (ejection frequency) from the nozzles A and B while conveying the paper at a uniform speed in the y direction. The ejection frequency and the paper conveyance speed are specified on the basis of the image formation resolution in the y direction, and the x-direction distance between the nozzles A and B is specified on the basis of the image formation resolution in the x direction.

As FIG. 1 reveals, the raster pitch D(y) between the rasters of the y-direction offset adjacent nozzle pair changes with the relative vibration between the head and the paper. The amount of change (variation) AD(y) in this pitch D(y) is expressed as shown below in terms of the y-direction offset amount OSy, the relative vibration period Pv, and the (single) amplitude of the relative vibration in the x direction, Av.

$$\Delta D(y) = Av \cdot [\sin\{\theta(y)\} - \sin\{\theta(y) + 2\pi \cdot OSy/Pv\}] \quad \text{Formula 2}$$
$$= 2 \cdot Av \cdot \sin\{-\pi \cdot OSy/Pv\} \cdot \cos\{\theta(y) + \pi \cdot OSy/Pv\}$$

Furthermore, the maximum value ΔDmax of the raster pitch variation is expressed as follows on the basis of Formula 1 above.

$$\Delta D\max = \max|\Delta D(y)| = 2 \cdot Av \cdot |\sin\{\pi \cdot OSy/Pv\}| \quad \text{Formula 3}$$

Here, ΔDmax is the amplitude of the raster pitch variation, and the value thereof is determined by Av, OSy and Pv. In other words, ΔDmax is a fixed component with respect to y (a value which is independent of y). On the other hand, the element cos {θ(y)+π·OSy/Pv} in Formula 2 is a variable component which varies with y.

Calculation of Formula 2

Figure 2:
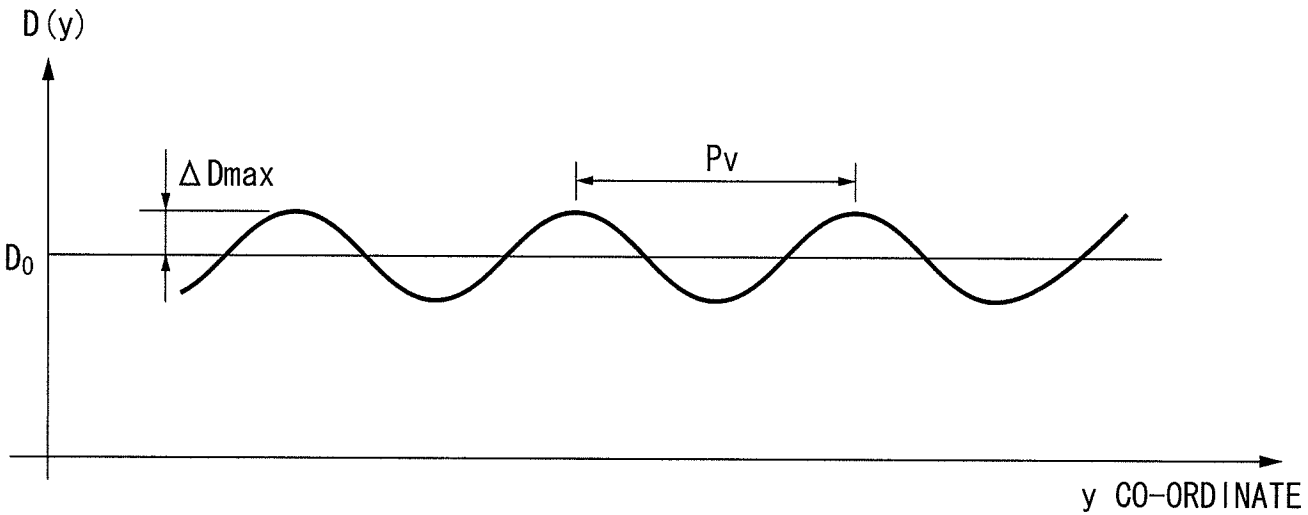
FIG. 2 is a graph showing an example of a state where the raster pitch D(y) of the y-offset adjacent nozzle pair varies.

If there is relative variation between the paper and the head, then the rasters drawn on the paper by a y-offset adjacent nozzle pair in the head fluctuate (undulate) with the period of that relative variation. As a result of this, as shown in FIG. 2, the x-direction pitch D(y) between the rasters varies depending on the position y in the paper conveyance direction (as a function of y).

The position (x-direction position) of the raster recorded by one nozzle A of the y-offset adjacent nozzle pair under consideration varies with a unidirectional amplitude Av to about the ideal position (reference position $x_1$), and this vibration is represented by a triangular function, and taking the phase component of the vibration to be θ(y), the amount of variation $\Delta X_A$ in the position $X_A$ of the raster produced by the nozzle A is expressed as follows as a function of y.

$$\Delta X_A = X_A(y) - x_1 = Av \sin\{\theta(y)\} \quad \text{Formula 4}$$

Similarly, the position of the raster (x direction position) recorded by the other nozzle B of the y-offset adjacent nozzle pair under consideration varies with a unidirectional amplitude Av about the ideal position (reference position $x_2$), and furthermore since there is an initial phase difference (2π·OSy/Pv) corresponding to the y-direction offset amount OSy between the nozzle A and the nozzle B, then the amount of variation $\Delta X_B$ of the position $X_B$ of the raster produced by nozzle B is expressed as follows as a function of y.

$$\Delta X_B = X_B(y) - x_2 = \sin\{\theta(y) + 2\pi \cdot OSy/Pv\} \quad \text{Formula 5}$$

Therefore, the amount of variation ΔD(y) in the x-direction pitch between the rasters formed by the "y-offset adjacent nozzle pair" constituted by the nozzle A and nozzle B can be expressed as a difference between the raster variation of nozzle A ($\Delta X_A$) and the raster variation of nozzle B ($\Delta X_B$), and is represented by Formula 2. The formula can be modified by using a product sum formula derived from an addition theorem. Furthermore, in the y-offset adjacent nozzle pair, it is not a fundamental issue which of the nozzles is designated as nozzle A or nozzle B, and a similar theory is established if the relationship between the nozzles is reversed.

FIG. 2 is a graph showing an example of a state where the raster pitch D(y) of the y-offset adjacent nozzle pair varies. The horizontal axis indicates the position on the paper in the y direction (y coordinate) and the vertical axis indicates the raster pitch D(y). If there is no relative vibration in the x direction between the head and the paper, then the ideal raster pitch is a specified value $D_0$ which is determined by the image formation resolution. For example, if the resolution is 1200 dpi, then $D_0$=1 pix=21.2 μm. However, if there is relative vibration in the x direction (vibration period Pv) between the head and the paper, then as shown in FIG. 2, the raster pitch D(y) varies with an amplitude of ΔDmax and a relative vibration period of Pv.

As stated in Formula 2, ΔDmax is a value specified by the relationship between OSy and Pv, and ΔDmax can take a value in the range of 0≤ΔDmax≤2Av, depending on the ratio between OSy and Pv (OSy/Pv).

Table 1 shows the relationship between the amplitude ΔDmax of the raster pitch variation and the vibration non-uniformity in a case where specific conditions are established between the offset amount OSy of the y-offset adjacent nozzle pair and the period Pv of the relative vibration in the x direction. In Table 1, k is zero or a non-negative integer.

TABLE 1

| Condition | OSy/Pv | $\pi \cdot$ OSy/Pv | $\sin\{\pi \cdot$ OSy/Pv$\}$ | ΔDmax | vibration non-uniformity |
|---|---|---|---|---|---|
| [1] | k | $k \cdot \pi$ | 0 | 0 | best or no non-uniformity |
| [2] | k + ½ | $(k + ½) \cdot \pi$ | ±1 | 2 · Av | worst |

Figure 3A:
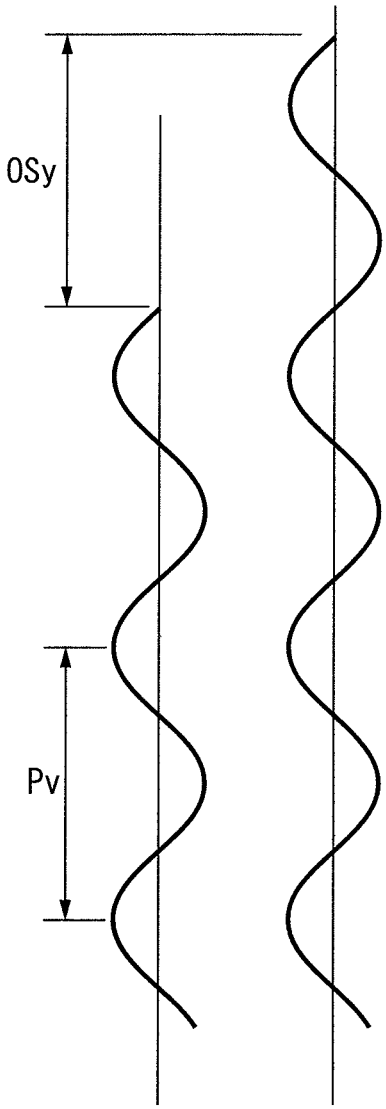
FIGS. 3A and 3B are illustrative diagrams showing an example of the relationship between the offset amount of a nozzle pair (OSy), the conditions of the relative vibration period (Pv) and the pitch variation between rasters.

Condition [1] in Table 1 corresponds to a practical example of the present invention, and indicates the best conditions yielding the minimum effect of relative vibration, since the offset amount OSy of the y-offset adjacent nozzle pair is an integral multiple of the vibration period Pv of the x-direction relative vibration (the phases of the variation of the two rasters which are mutually adjacent in the x direction arc matching) (see FIG. 3A).

Figure 3B:
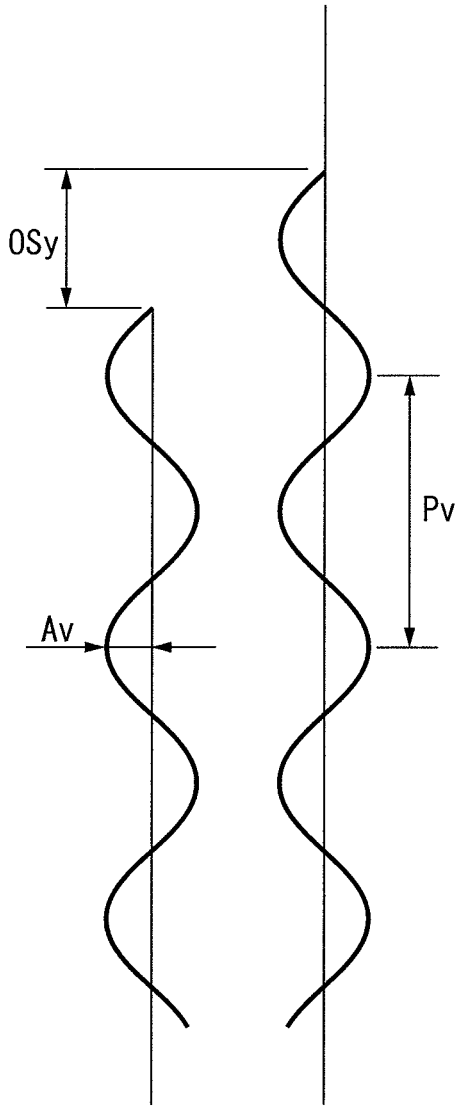

On the other hand, the condition [2] indicated in the bottom part of Table 1 corresponds to a comparative example, and since the offset amount OSy of the y-offset adjacent nozzle pair is (k+½) times the vibration period Pv of the x-direction relative vibration, then the phase angle of the variation is displaced by precisely π between the rasters which are mutually adjacent in the x direction. Therefore, the amplitude ΔDmax (single amplitude) of the variation of the raster pitch is twice the amplitude Av (single amplitude) of the relative vibration (see FIG. 3B). In this case, the effects of the relative vibration are emphasized most strongly, and hence the worst conditions are obtained in which vibration non-uniformity is highly conspicuous on the paper.

Figure 4:
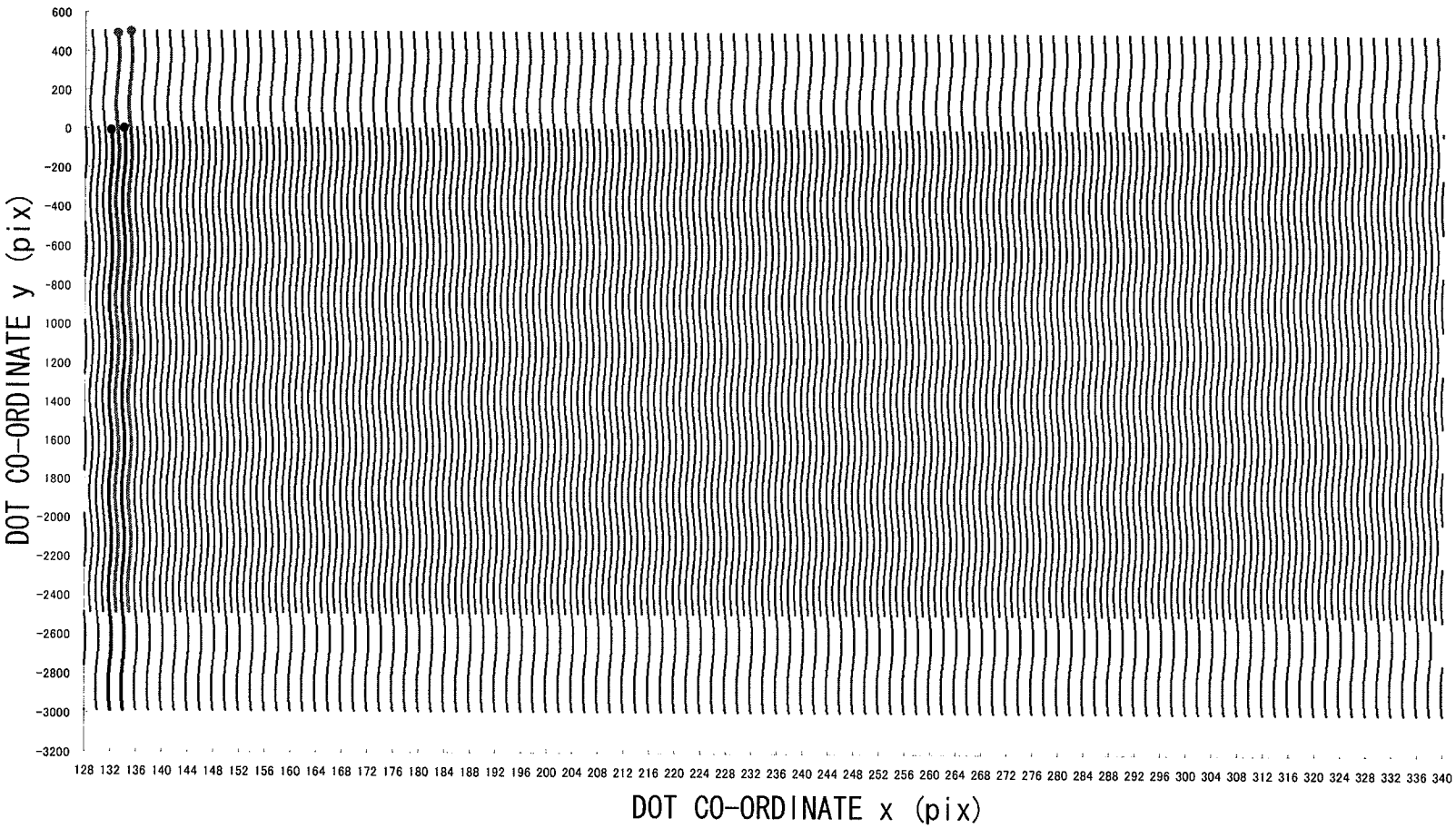
FIG. 4 is a diagram showing an example of rasters obtained by applying the present invention to a head having a two-dimensional nozzle arrangement in two rows and N columns.
Figure 5:
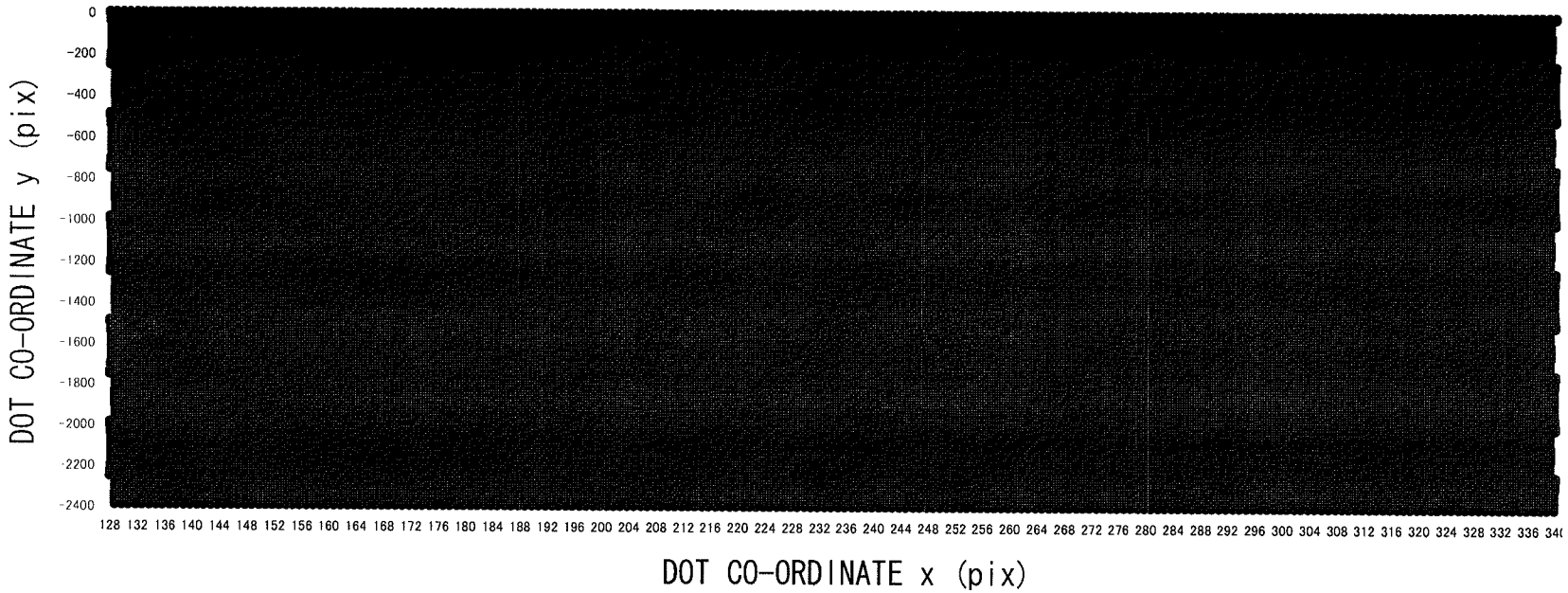
FIG. 5 is a diagram showing an example of an image (solid image) formed under the conditions shown in FIG. 4.
Figure 29:
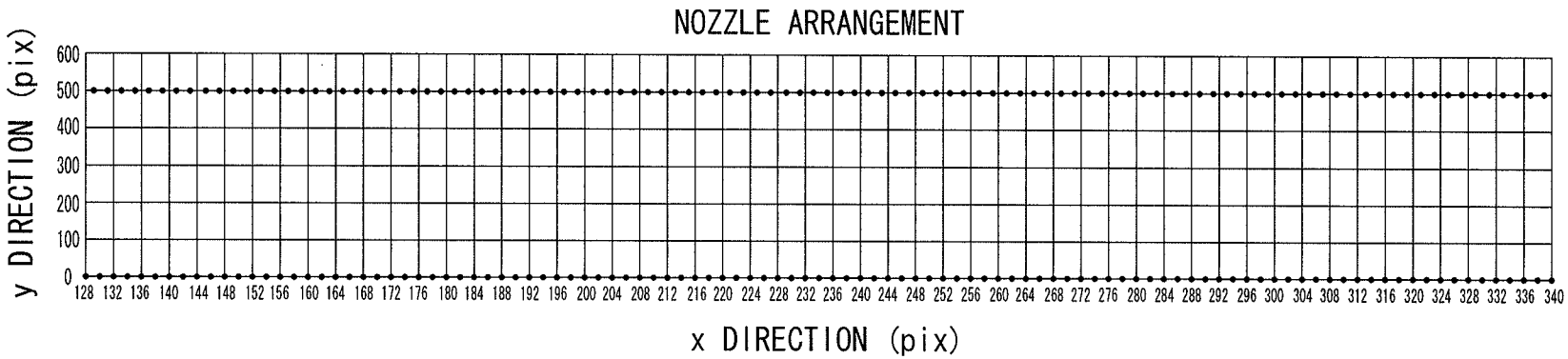
FIG. 29 RELATED ART
FIG. 29 is a nozzle layout diagram showing an example of a two-dimensional nozzle arrangement comprising two rows×N columns.
Figure 30:
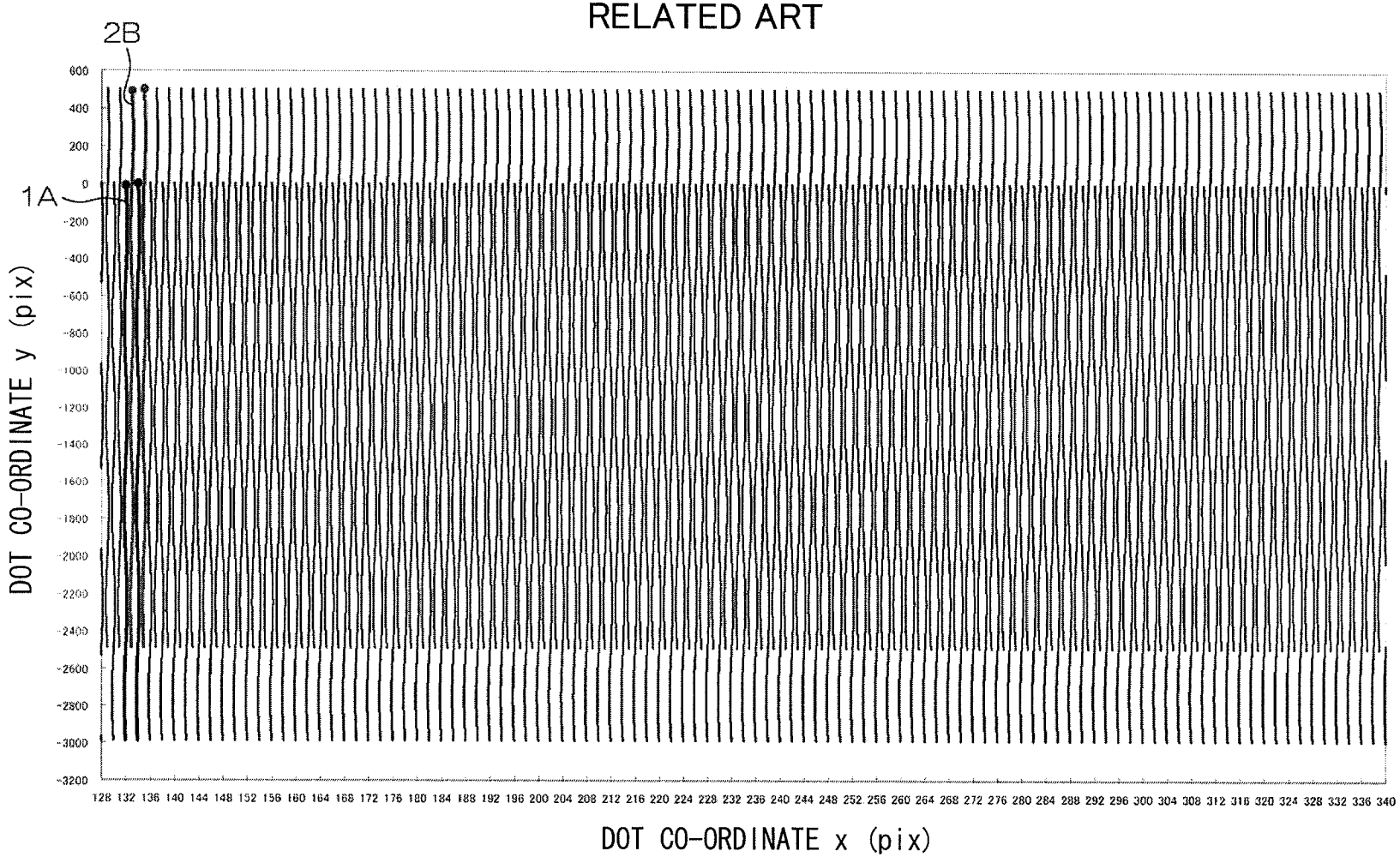
FIG. 30 RELATED ART
FIG. 30 is a diagram showing rasters obtained by a related-art inkjet recording apparatus which uses the nozzle arrangement in FIG. 29.
Figure 31:
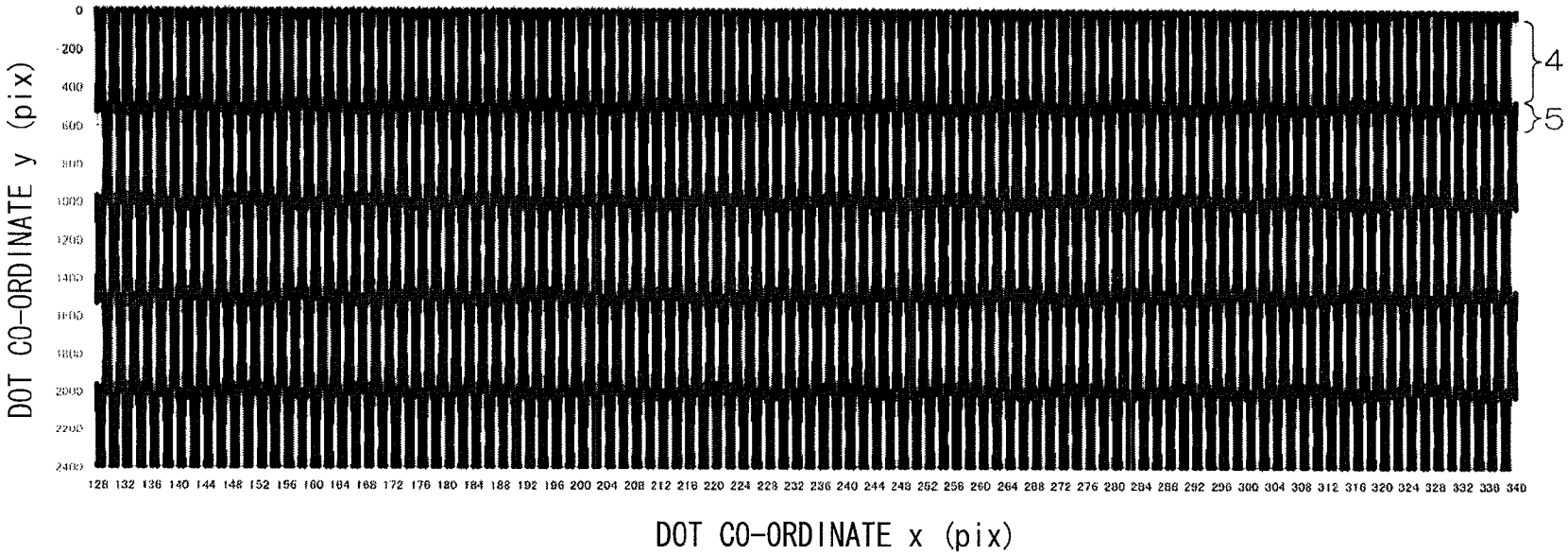
FIG. 31 RELATED ART
FIG. 31 is a diagram showing an example of an image (solid image) formed under the conditions shown in FIG. 30.

The example shown in FIG. 30 and FIG. 31 corresponds to condition [2] in Table 1. FIG. 4 and FIG. 5 show an example of image formation results in a case where the relationship between the relative vibration period Pv and the offset amount OSy corresponds to condition [1] in Table 1 relating to a nozzle arrangement of two rows×N columns shown in FIG. 29.

Figure 6:
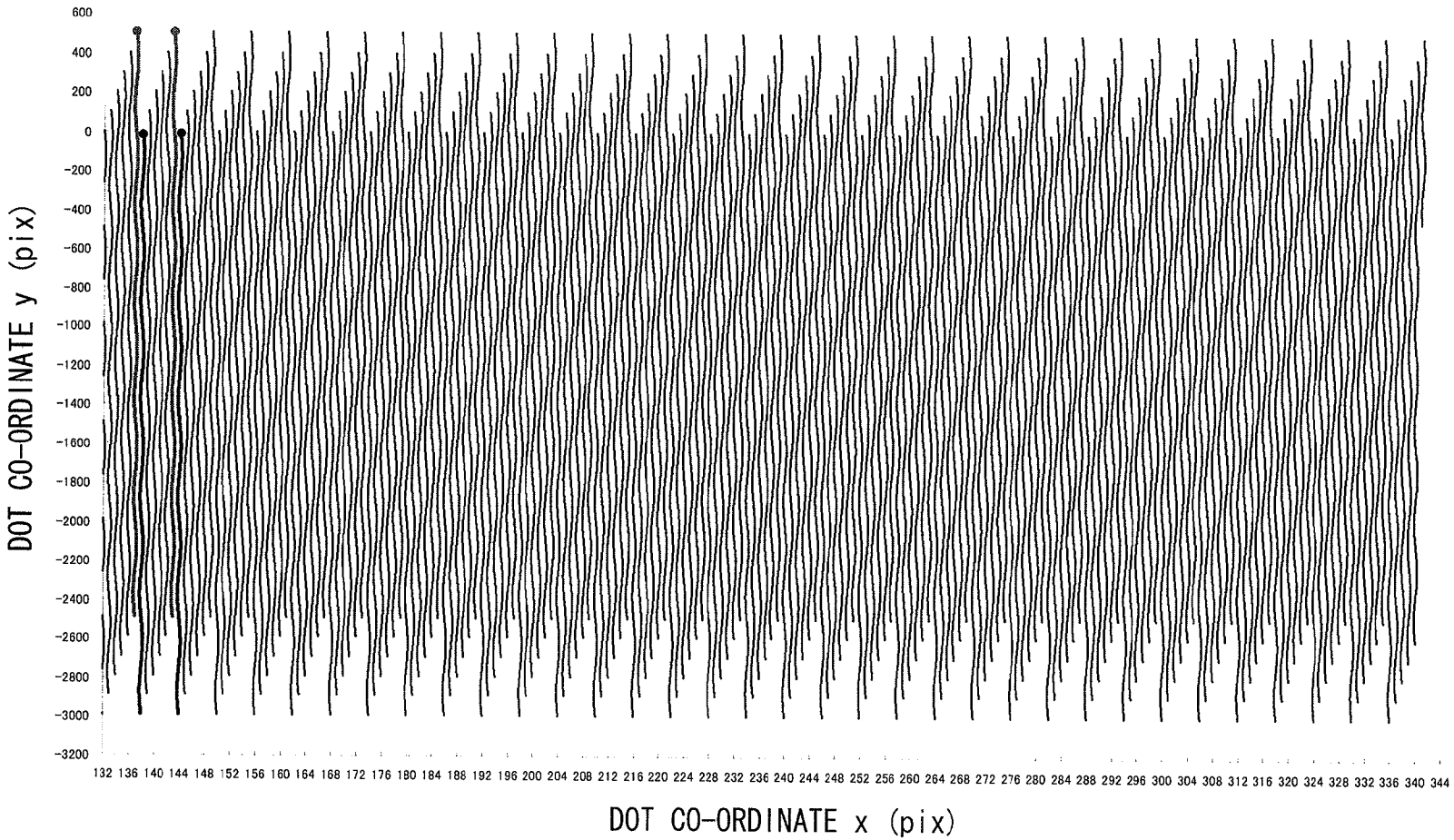
FIG. 6 is a diagram showing an example of rasters obtained by applying the present invention to a head having a two-dimensional nozzle arrangement in six rows and N columns.
Figure 7:
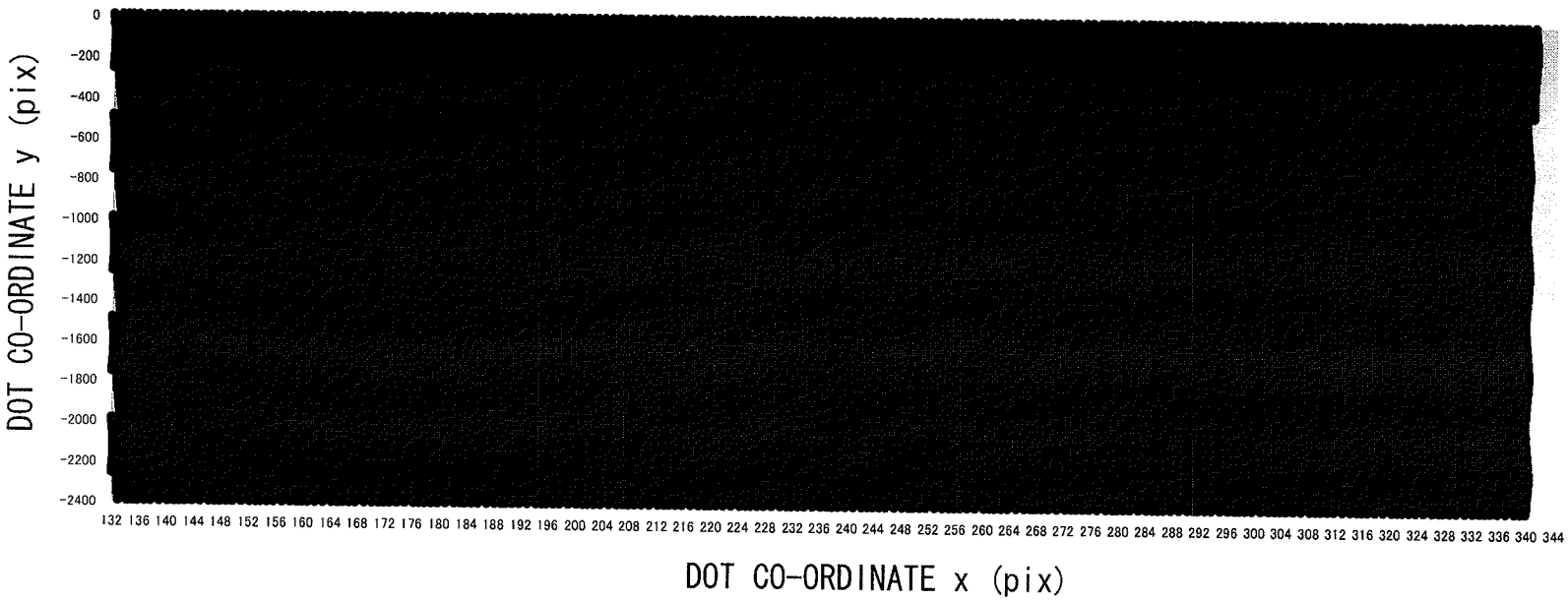
FIG. 7 is a diagram showing an example of an image (solid image) formed under the conditions shown in FIG. 6.
Figure 32:
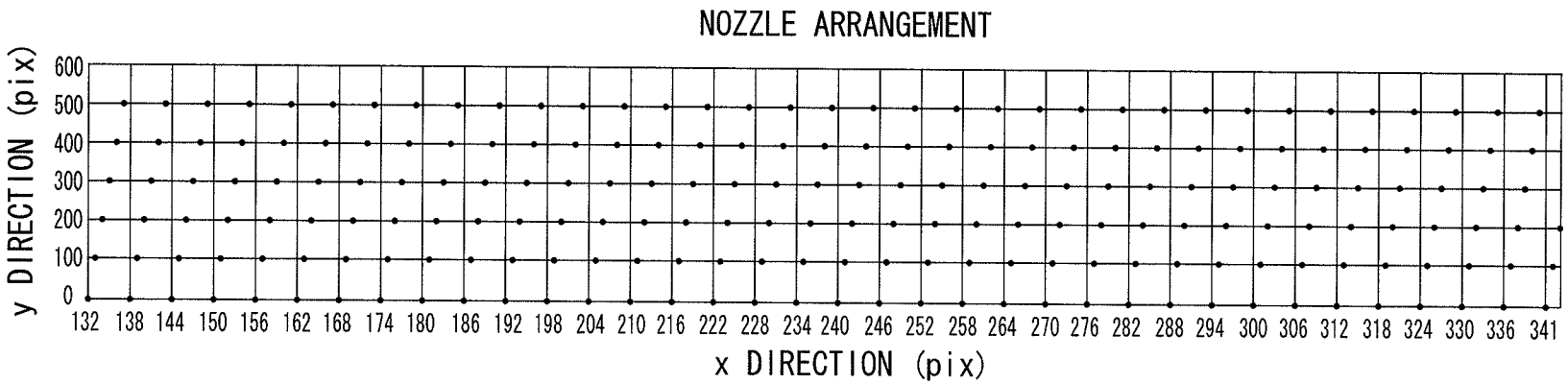
FIG. 32 RELATED ART
FIG. 32 is a nozzle layout diagram showing an example of a two-dimensional nozzle arrangement comprising six rows×N columns.
Figure 33:
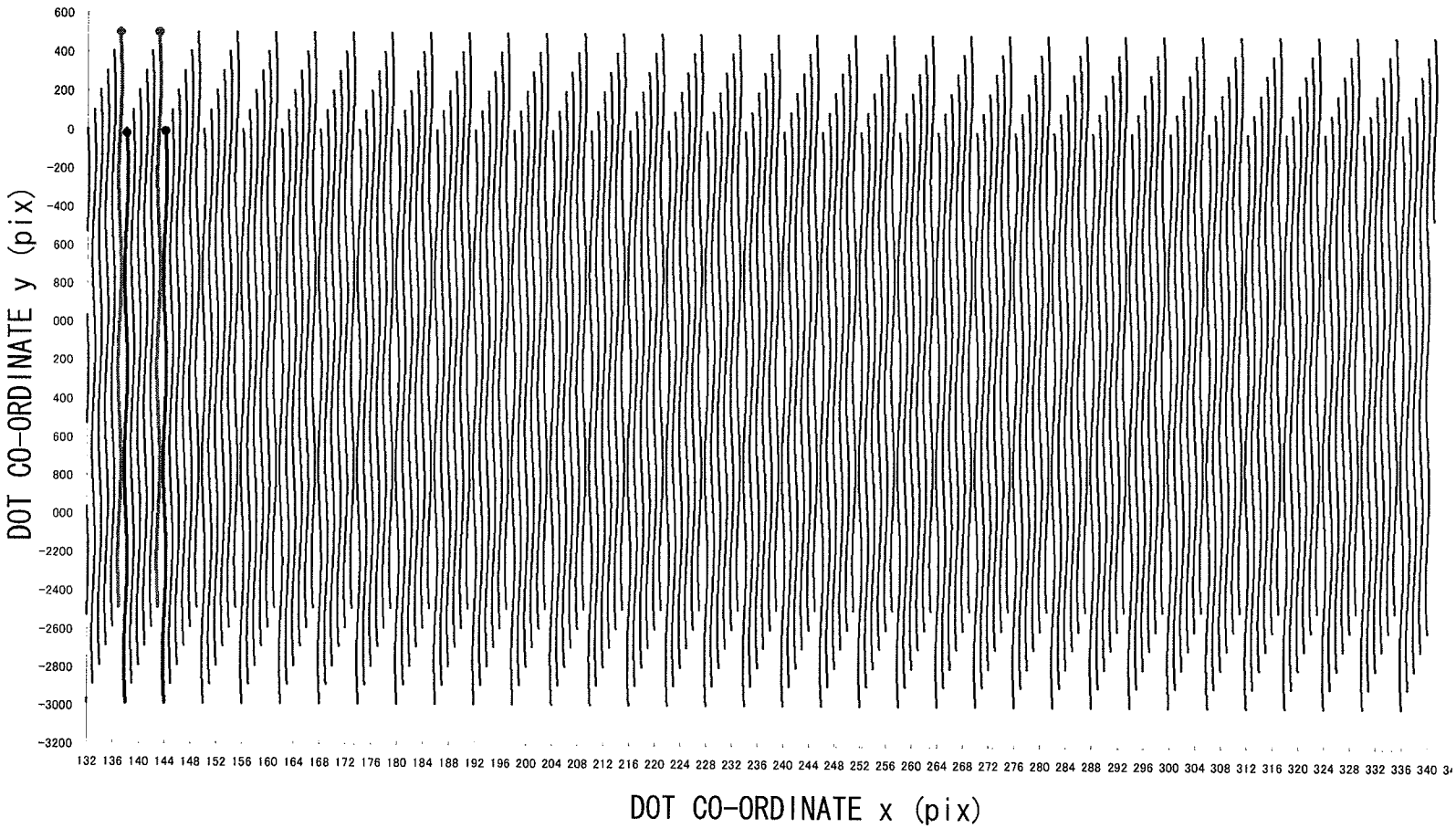
FIG. 33 RELATED ART
FIG. 33 is a diagram showing rasters obtained by a related-art inkjet recording apparatus which uses the nozzle arrangement in FIG. 32.
Figure 34:
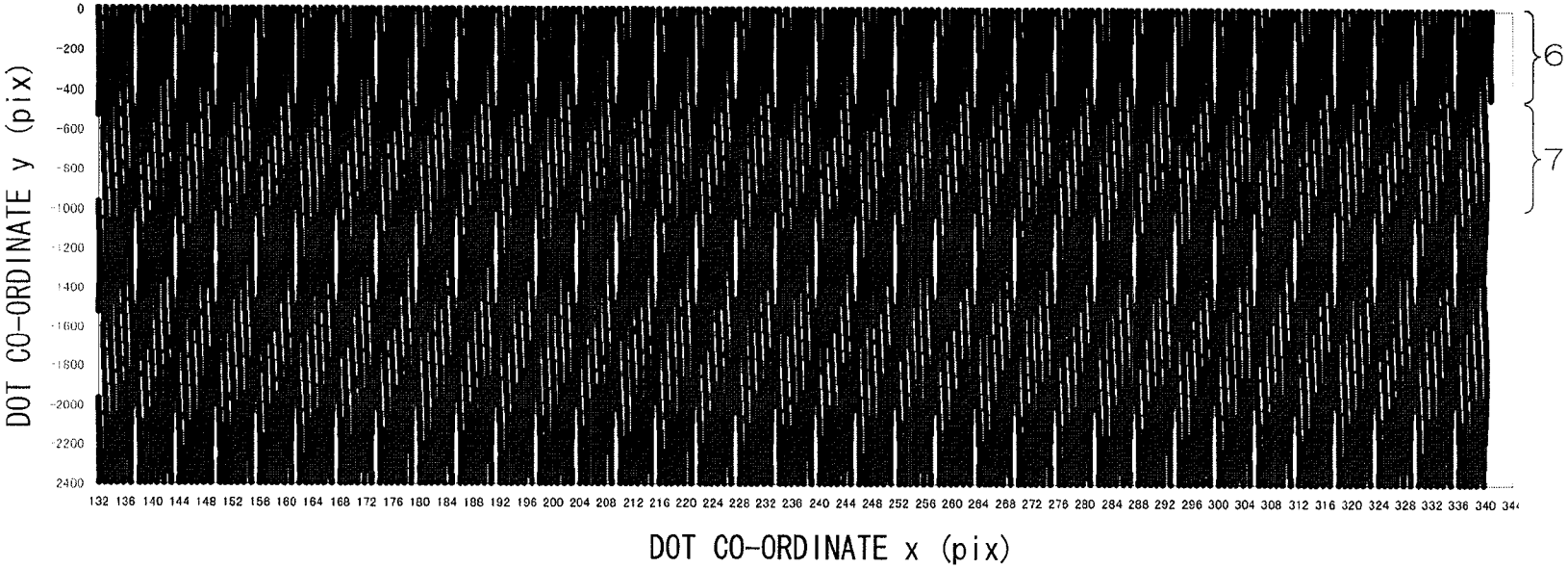
FIG. 34 RELATED ART
FIG. 34 is a diagram showing an example of an image (solid image) formed under the conditions shown in FIG. 32.

Furthermore, FIG. 6 and FIG. 7 show image formation results in a case corresponding to condition [1] in Table 1, for a nozzle arrangement of six rows×N columns shown in FIG. 32 (incidentally, FIG. 33 and FIG. 34 correspond to condition [2] in Table 1).

In FIG. 5 and FIG. 7 which correspond to the favorable condition [1], it can be seen that the vibration non-uniformity, which appears in FIG. 31 and FIG. 34, is reduced. For the purpose of comparison, the single amplitude of the relative vibration is the same value of 5 μm here, and the period of the relative vibration is 500 pix=10.6 mm (2) Means for Reducing the Visibility of Vibration Non-Uniformity In order to reduce the visibility of vibration non-uniformities, means for suppressing the actual vibration (a countermeasure for the main cause) is adopted, as well as devising a countermeasure for the subsidiary cause which is based on the relationship between the nozzle arrangement and the vibration period. In the present embodiment, principally, the following composition is adopted in order to reduce x-direction relative vibration between the image formation drum (pressure drum) and the line head.

A. Adoption of a head fixing structure to fix the line head under pressure to the main body frame.

B. Adoption of a drum axle fixing structure to fix the rotating axle of the image formation drum (pressure drum axle), or the like, under pressure to the main body frame.

C. Optimization of the design of the head fixing structure and the drum axle fixing structure to take account of the subsidiary cause.

Below, a specific compositional example is described.

Example of Composition of Inkjet Recording Apparatus

Figure 8:
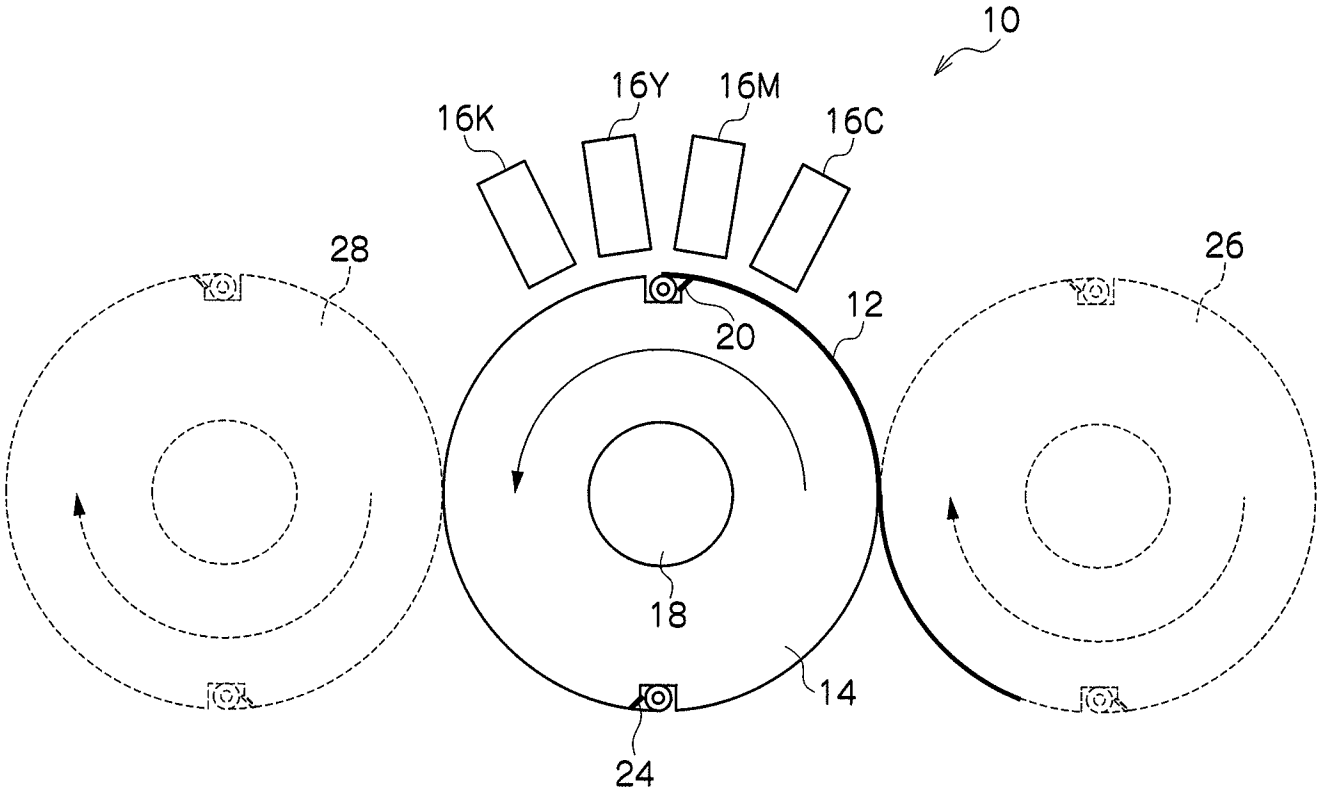
FIG. 8 is a schematic drawing of an image formation unit of an inkjet recording apparatus relating to an embodiment of the present invention.

FIG. 8 is a schematic drawing of an image formation unit of an inkjet recording apparatus relating to an embodiment of the present invention. The inkjet recording apparatus according this embodiment is a so-called line printer, which prints onto cut sheet paper (hereinafter, called "paper") using a line head. As shown in FIG. 8, in the image formation unit 10, the paper 12 is conveyed on an image formation drum 14. Droplets of inks of C (cyan), M (magenta), Y (yellow) and K (black) are ejected from four line heads 16C, 16M, 16Y and 16K, onto paper 12 which is conveyed by the image formation drum 14, thereby forming a color image on the recording surface.

Grippers 24 are provided on the circumferential surface of the image formation drum 14. The paper 12 is conveyed with the leading end portion thereof being gripped by a gripper 24. In the image formation drum 14 according to the present embodiment, grippers 24 are provided in two positions on the circumferential surface at an interval of 180° apart, in such a manner that two sheets of paper 12 can be conveyed in one revolution.

Furthermore, the paper 12 is conveyed by being held by suction on the circumferential surface of the image formation drum 14. A plurality of suction holes (not illustrated) are formed in a prescribed pattern in the circumferential surface of the image formation drum 14, and the paper 12 is held by suction on the circumferential surface of the image formation drum 14 by suctioning air from these suction holes. The composition for suctioning and holding the paper 12 is not limited to this and it is also possible to adopt a composition in which the paper 12 is suctioned and held by electrostatic attraction.

The paper 12 which is supplied to the image formation unit 10 is transferred to an image formation drum 14 by a transfer drum 26 which is arranged in a stage before the image formation drum 14. On the other hand, the paper 12 after image formation is transferred to a transfer drum 28 which is arranged in a stage after the image formation drum 14.

The four line heads 16C, 16M, 16Y and 16K are disposed in a radiating fashion at a uniform spacing apart in a concentric fashion with the center of the rotating axle 18 of the image formation drum 14. Ink droplets are ejected perpendicularly toward the outer circumferential surface of the image formation drum 14 from the line heads 16C, 16M, 16Y and 16K. A color image is formed on the recording surface of the paper 12 by depositing the ink droplets ejected from the line heads 16C, 16M, 16Y and 16K onto the recording surface.

Figure 9:
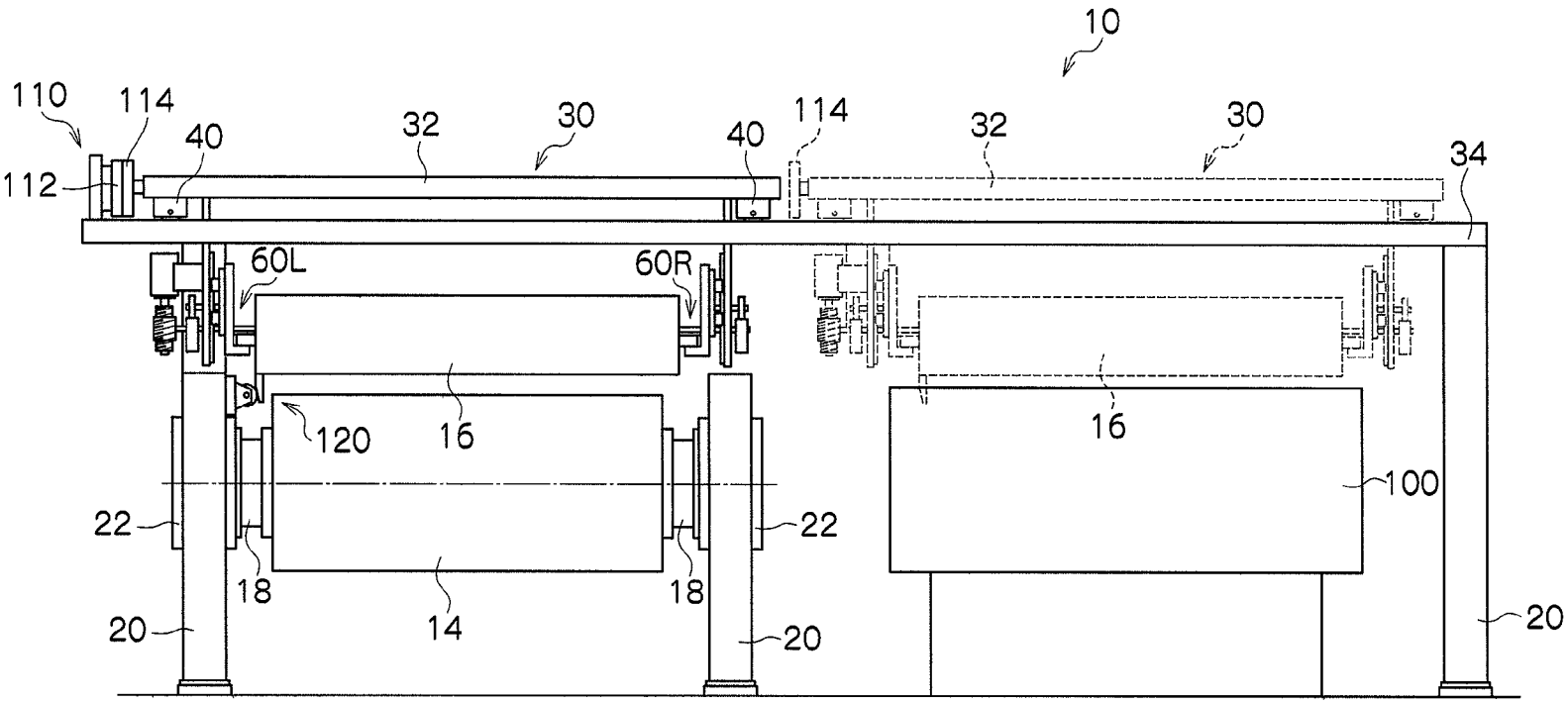
FIG. 9 is a front view diagram of an image formation unit and a maintenance unit aligned with this image formation unit.
Figure 10:
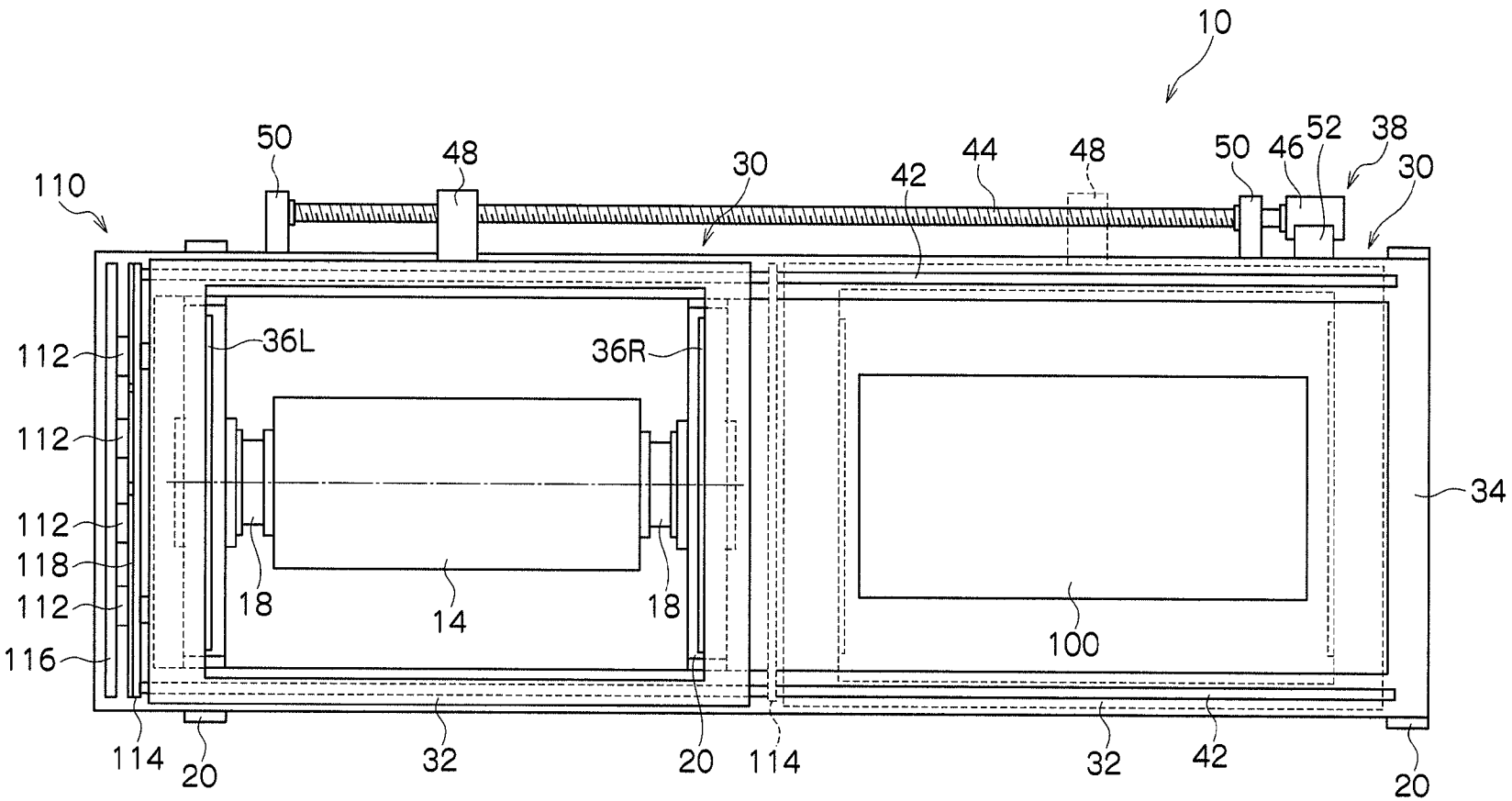
FIG. 10 is a plan diagram of the image formation unit and the maintenance unit aligned with this image formation unit.

FIG. 9 is a front view diagram of an image formation unit 10 and a maintenance unit which is aligned with same, and FIG. 10 is a plan view diagram of same. The four line heads 16C, 16M, 16Y and 16K provided for the respective ink colors are mounted on a common carriage 30, so as to be movable between an image formation position for forming an image on the paper 12 (the position of the solid lines in FIG. 9 and FIG. 10) and a maintenance position for carrying out prescribed maintenance (the position of the dotted lines in FIG. 9 and FIG. 10).

As shown in FIG. 9 and FIG. 10, the image formation drum 14 is disposed on a main body frame 20 of an inkjet recording apparatus. A pair of bearings 22 which support the image formation drum 14 are provided on the main body frame 20. The respective end to portions of the rotating axle 18 of the image formation drum 14 are supported by the bearings 22, and are thereby disposed rotatably on the main body frame 20.

An image formation drum drive motor (not illustrated) is coupled to the rotating axle 18 of the image formation drum 14 supported on the bearings 22, via a rotation transmission mechanism (not illustrated). The image formation drum 14 rotates by being driven by this image formation drum drive motor.

The carriage 30 is constituted by a movable carriage main body 32, a pair of left and right side plates 36L, 36R which are provided on the carriage main body 32, and a carriage drive mechanism 38 which moves the carriage main body 32 (in FIG. 10, only the carriage main body 32 and the side plates are shown for the sake of convenience, and the line heads of the respective ink colors and the mounting platform on which the line heads are mounted, and the like, are not depicted).

The carriage main body 32 is formed in a square frame shape, and wheels 40 are installed on the lower four corners thereof, thus making the carriage main body 32 movable. This carriage main body 32 is mounted on a ceiling frame 34 which is spanned on the main body frame 20.

The ceiling frame 34 is formed in a square frame shape, and is fixed to the main body frame 20 by bolts, which are not illustrated. The ceiling frame 34 which is fixed to the main body frame 20 is arranged horizontally, above the image formation drum 14.

A pair of rails 42 are arranged on the upper face of the ceiling frame 34. The rails 42 are formed as grooves of a prescribed width and a prescribed depth in the upper surface of the ceiling frame 34, and are formed in parallel with the rotating axle 18 of the image formation drum 14. The wheels 40 which are provided on the carriage main body 32 fit into these rails 42. By this means, the direction of movement of the carriage main body 32 is restricted. Consequently, the carriage main body 32 moves horizontally in the same straight line. In other words, the carriage main body 32 moves horizontally in parallel with the rotating axle 18 of the image formation drum 14.

The carriage drive mechanism 38 is constituted by a screw bar 44 which is arranged in parallel with the rails 42, a carriage drive motor 46 which drives the screw bar 44 to rotate, and a coupling member 48 which screws together with the screw bar 44 and is also coupled to the carriage main body 32.

The screw bar 44 is disposed in one side portion of the ceiling frame 34. Bearing sections 50 which rotatably support the respective end sections of the screw bar 44 are provided on the one side portion of the ceiling frame 34. The screw bar 44 is disposed in parallel with the rails 42 and is supported rotatably, by either end portion thereof being supported by the bearing sections 50.

A carriage drive motor 46 is installed on the one side part of the ceiling frame 34 via a bracket 52. One end of the screw bar 44 is coupled to the output shaft of the carriage drive motor 46. The screw bar 44 is driven to rotate by a carriage drive motor 46.

A screw hole (not illustrated) is formed in the coupling member 48. The coupling member 48 screws together with the screw bar 44 via this screw hole. The coupling member 48 is fixed to the carriage main body 32 by bolts, which are not illustrated.

In the carriage drive mechanism 38 which is composed in this way, when the screw bar 44 is turned by driving the carriage drive motor 46, the coupling member 48 moves along the screw bar 44. As a result of this, the carriage main body 32 moves horizontally along the rails 42.

The left and right pair of side plates 36L, 36R are formed in a flat plate shape, and are installed so as to hang downwards below the carriage main body 32. The pair of side plates 36L, 36R arranged in the carriage main body 32 are disposed perpendicularly with respect to the rotating axle 18 of the image formation drum 14, as well as being disposed in mutually opposing fashion at a uniform interval apart. A left and right-hand pair of mounting platforms 60L and 60R for installing line heads 16C, 16M, 16Y, 16K are provided on the pair of side plates 36L, 36R, for each of the line heads 16C, 16M, 16Y and 16K.

Figure 11:
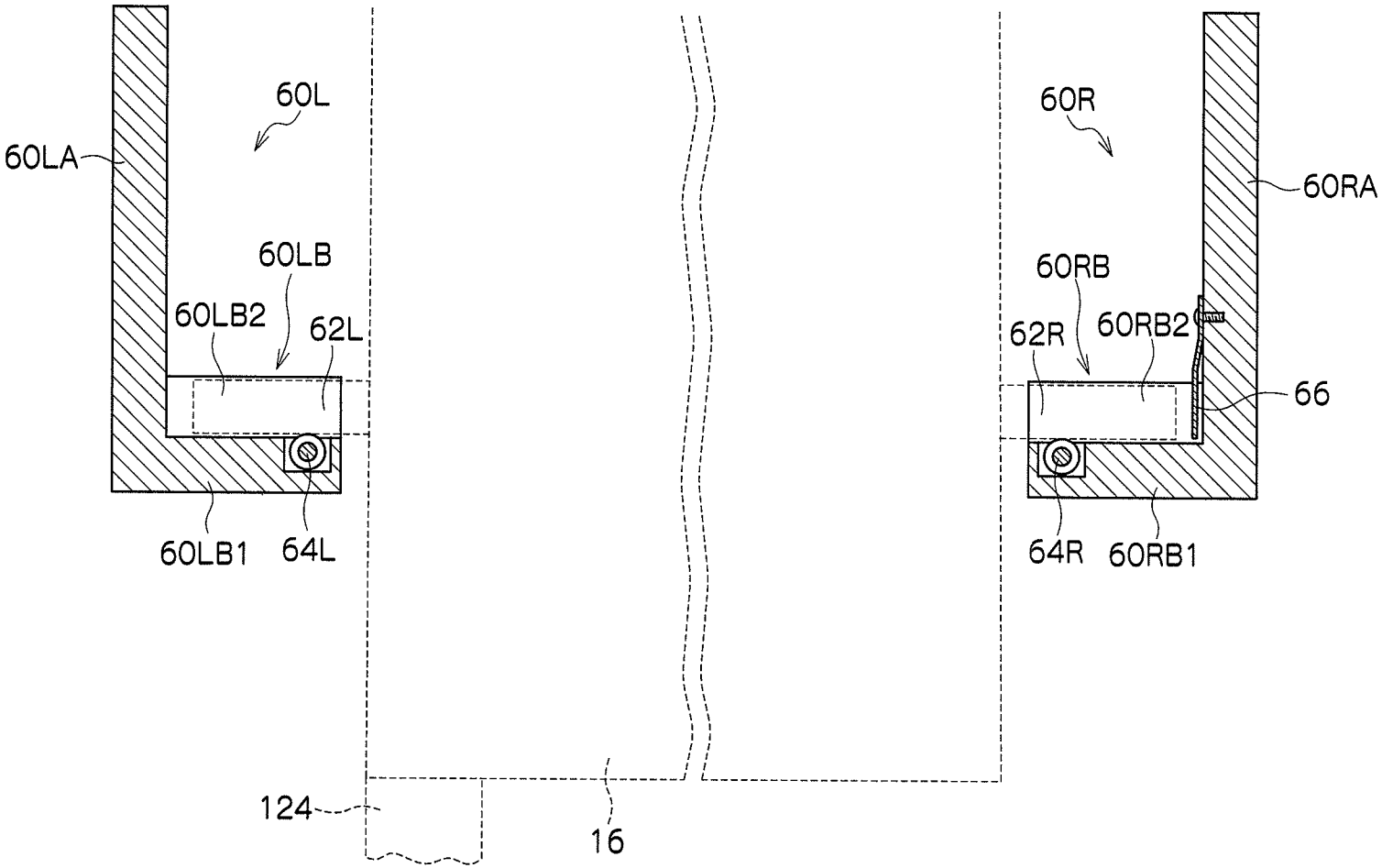
FIG. 11 is a cross-sectional diagram showing a composition of a mounting platform for holding a line head.

FIG. 11 is a cross-sectional diagram showing the composition of the mounting platforms 60L and 60R. The line heads 16C, 16M, 16Y, 16K have the same structure as each other, and the mounting platforms 60L, 60R on which the respective line heads 16C, 16M, 16Y and 16K are installed also have the same structure as each other, and therefore the installation structure on the mounting platforms 60L and 60R is described here for a line head 16.

The line head 16 is formed in a rectangular block shape, and has flange sections 62L, 62R on either end in the width direction thereof (the direction perpendicular to the paper conveyance direction; in this case, the left/right direction). The flange sections 62L, 62R are formed as square flat plate-shaped projecting plates which extend horizontally (in parallel with the nozzle surface) from the respective left and right side surfaces of the main body section of the line head 16. The line head 16 is installed by placing the flange sections 62L, 62R on the mounting platforms 60L, 60R.

One mounting platform 60L is composed principally by a slide section 60LA and a mounting section 60LB.

The slide section 60LA is formed in a square flat plate shape. This slide section 60LA is arranged in parallel with the side plate 36L and is provided slidably along the side plate 36L by means of a slide supporting mechanism, which is described below.

The mounting section 60LB is composed of a horizontal section 60LB1 and a vertical section 60LB2, and as a whole, is formed in an L shape.

The horizontal section 60LB1 is formed in a square plate shape and is formed integrally with the lower end portion of the slide section 60LA. This horizontal section 60LB1 is arranged perpendicularly with respect to the inner surface of the slide section 60LA, and is also arranged in parallel with the rotating axle 18 of the image formation drum 14. The lower surface portion of the flange section 62L is placed on the horizontal section 60LB1.

A pair of rollers 64L are disposed on the front end portion of the horizontal section 60LB1. The rollers 64L are arranged in parallel in a direction perpendicular to the rotating axle 18 of the image formation drum 14, it is supported rotatably at the periphery of the axle perpendicular to the rotating axle 18 of the image formation drum 14. The lower surface portion of the flange section 62L is mounted on the roller 64L.

The vertical section 60LB2 is formed in a square plate shape and is formed integrally with the lower end portion of the slide section 60LA. This vertical section 60LB2 is disposed on one side of the horizontal unit 60LB1 (the lower side of the direction of inclination of the line head 16 which is arranged at an inclination), so as to be perpendicular with the inner surface of the slide section 60LA, and is arranged perpendicularly with respect to the horizontal section 60LB1. In the flange section 62L which is mounted on the horizontal section 60LB1, a side face which is positioned on the lower side in the direction of inclination is supported by the vertical section 60LB2.

The other mounting platform 60R also has a similar composition. In other words, the other mounting platform 60R is constituted mainly by a slide section 60RA and a mounting section 60RB. The mounting platform 60RB is constituted by a horizontal section 60RB1 and a vertical section 60RB2, and a pair of rollers 64R are provided on the front end portion of the horizontal section 60RB1.

The line head 16 is installed on the carriage 30, by mounting the lower surfaces of the left and right-hand flange sections 62L and 62R on the horizontal sections 60LB1, 60RB1 of the left and right-hand mounting platforms 60L and 60R.

Here, as described above, rollers 64L and 64R are provided with the horizontal sections 60LB1, 60RB1, and the flange sections 62L and 62R are mounted on these rollers 64L and 64R. As a result of this, the line head 16 mounted on the mounting platforms 60L and 60R is supported movably in the width direction (the direction parallel to the rotating axle 18 of the image formation drum 14).

A plate spring 66 is arranged on the inner surface of the slide section 60RA of one mounting platform 60R. This plate spring 66 is a member which is required when fixing the line head 16, and abuts against the side face of the flange section 62R of the line head 16 which is mounted on one mounting platform 60R and impels the line head toward the other mounting platform 60L. The action of this plate spring 66 is described in detail hereinafter.

As described above, the mounting platforms 60L, 60R are provided in such a manner that the slide sections 60LA, 60RA are movable along the side plates 36L, 36R by means of the slide supporting mechanisms 76L, 76R.

Figure 12:
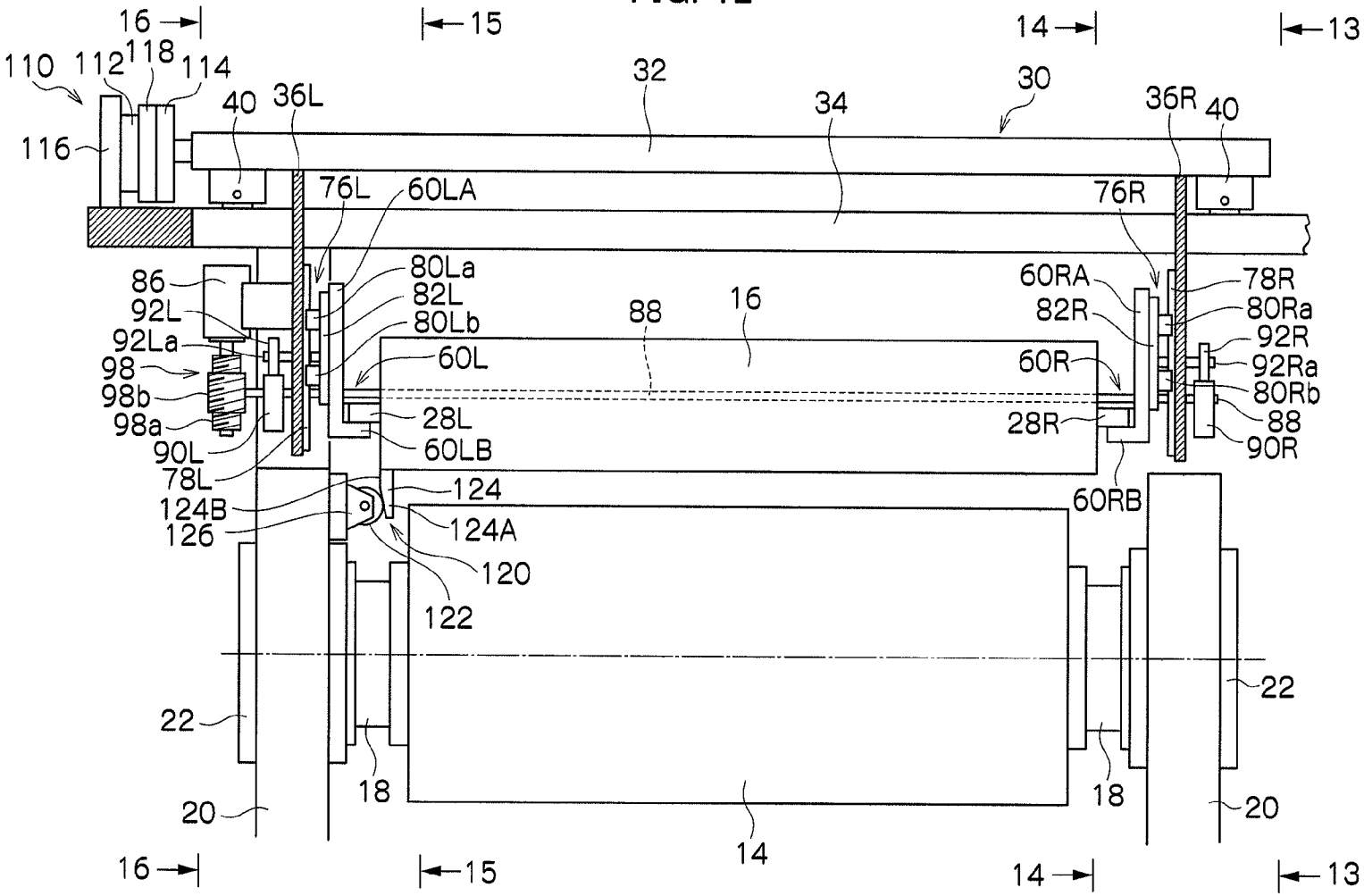
FIG. 12 is a front view diagram showing the composition of a mounting platform provided on a carriage.
Figure 13:
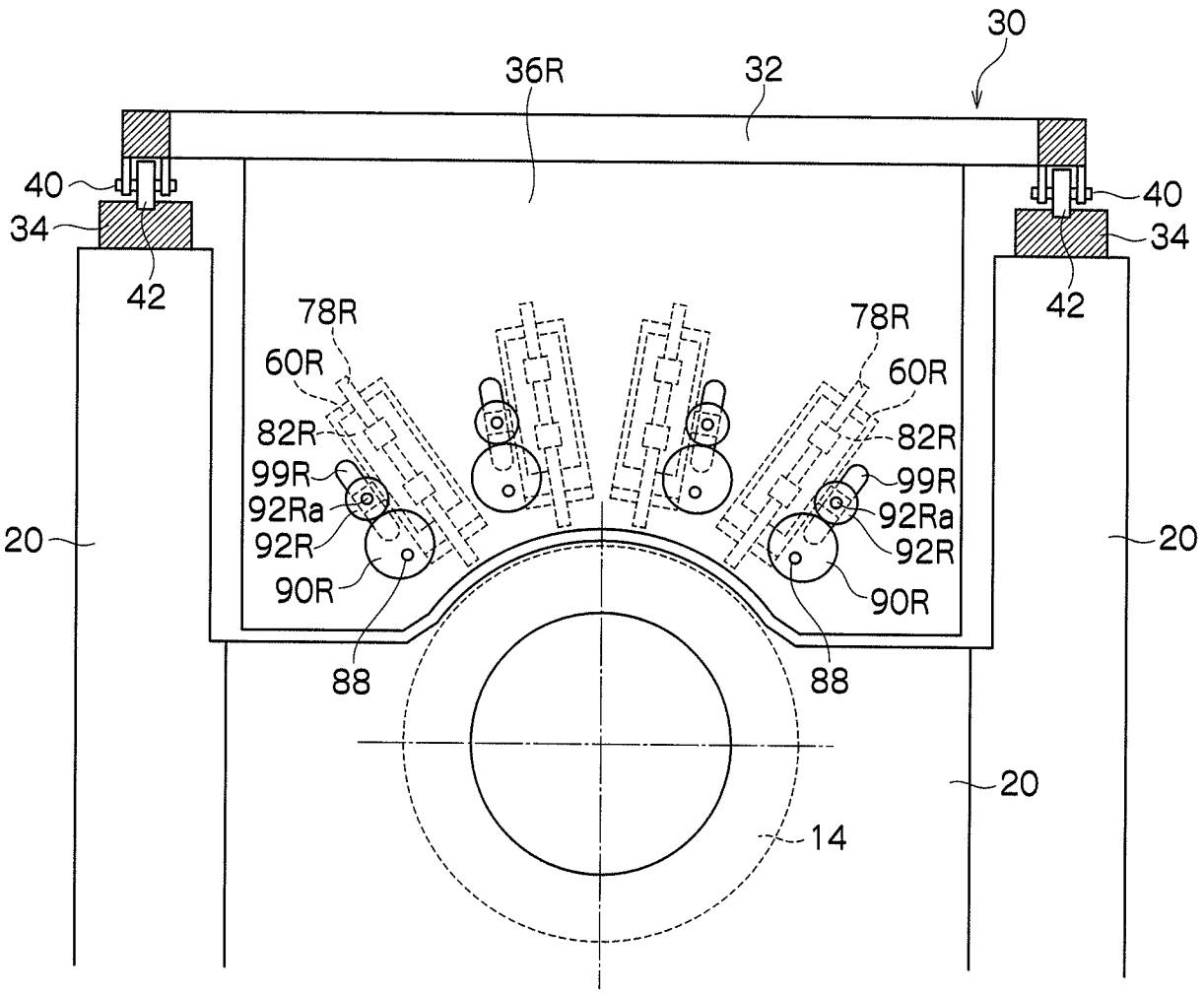
FIG. 13 is a view along arrow 13-13 in FIG. 12.
Figure 14:
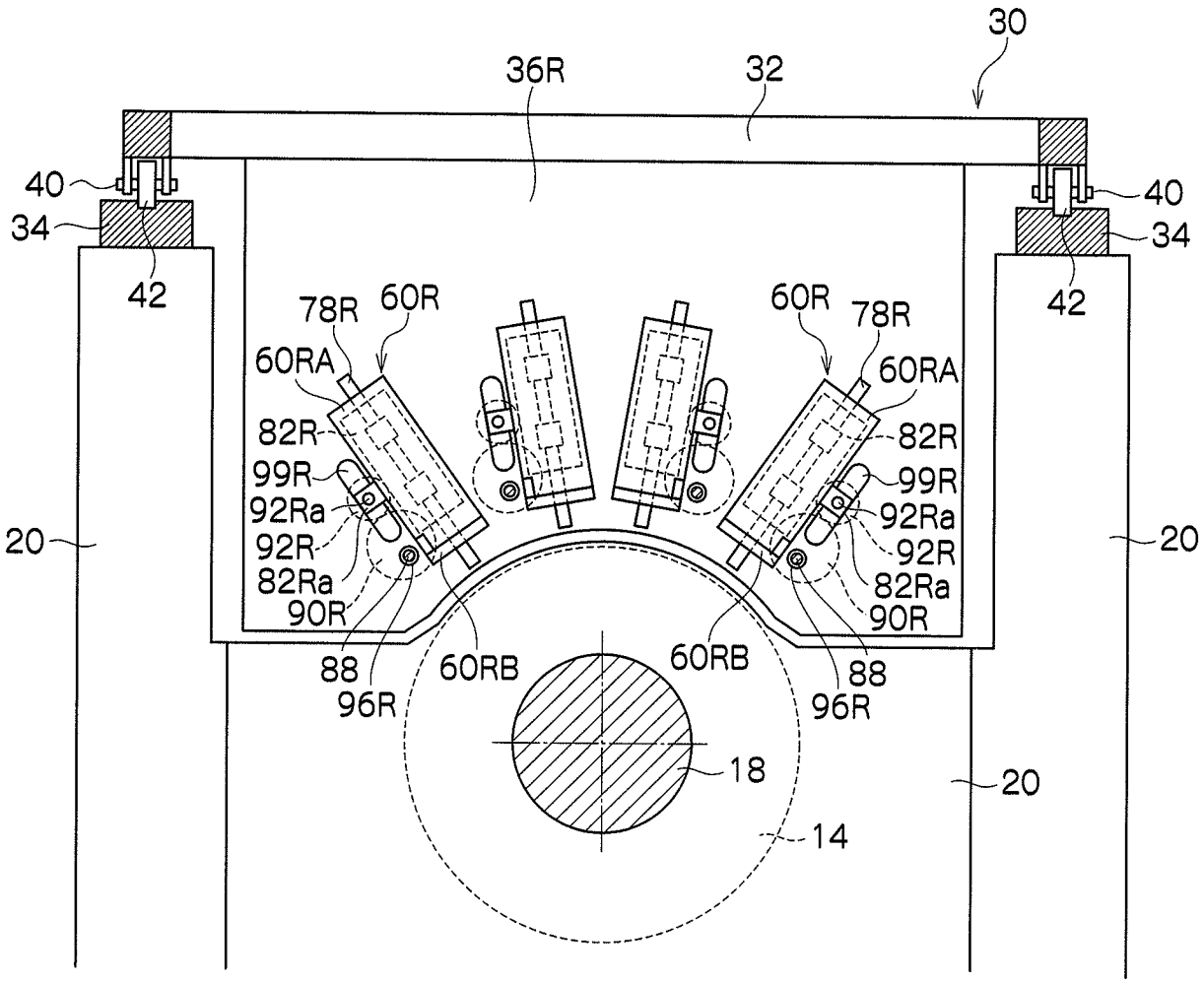
FIG. 14 is a view along arrow 14-14 in FIG. 12.
Figure 15:
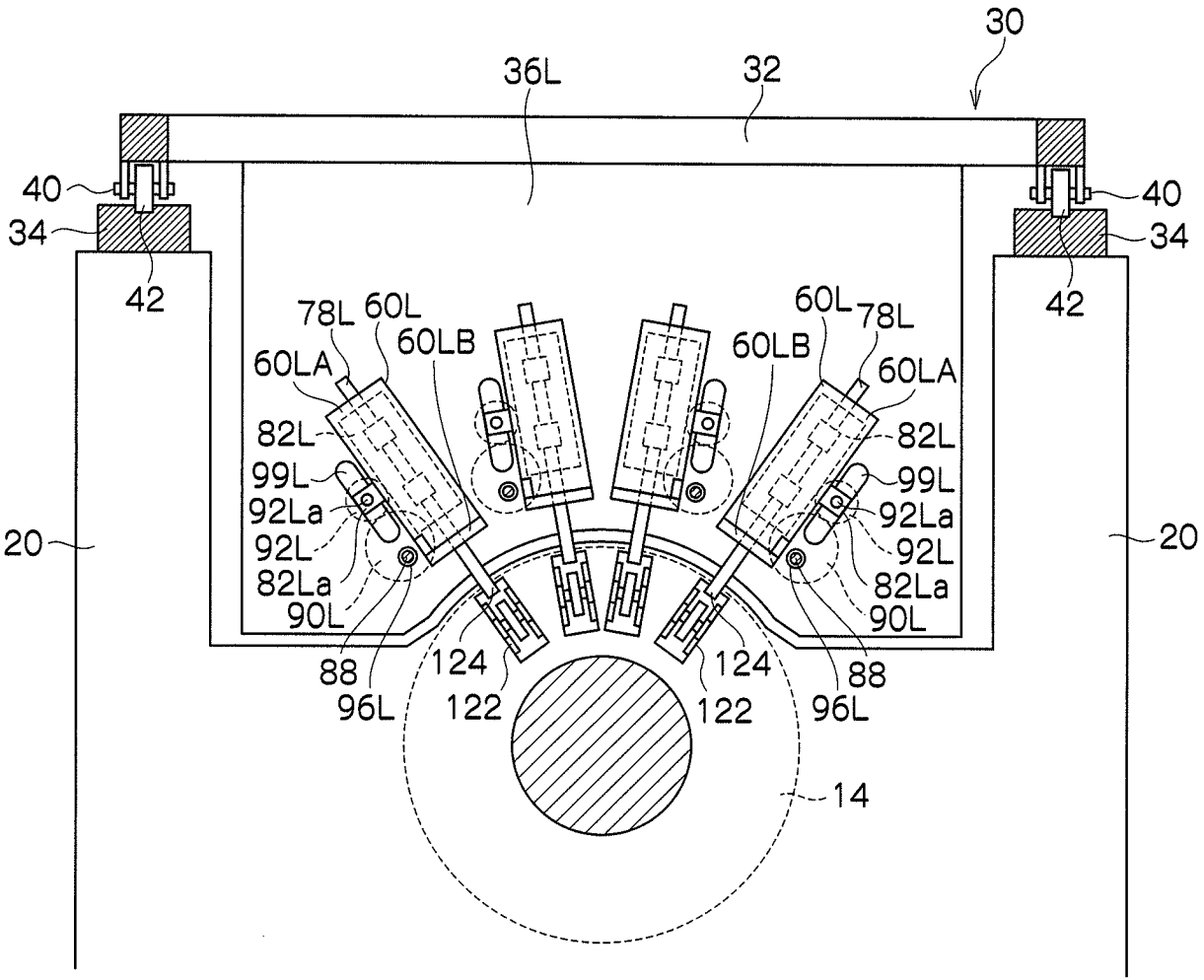
FIG. 15 is a view along arrow 15-15 in FIG. 12.
Figure 16:
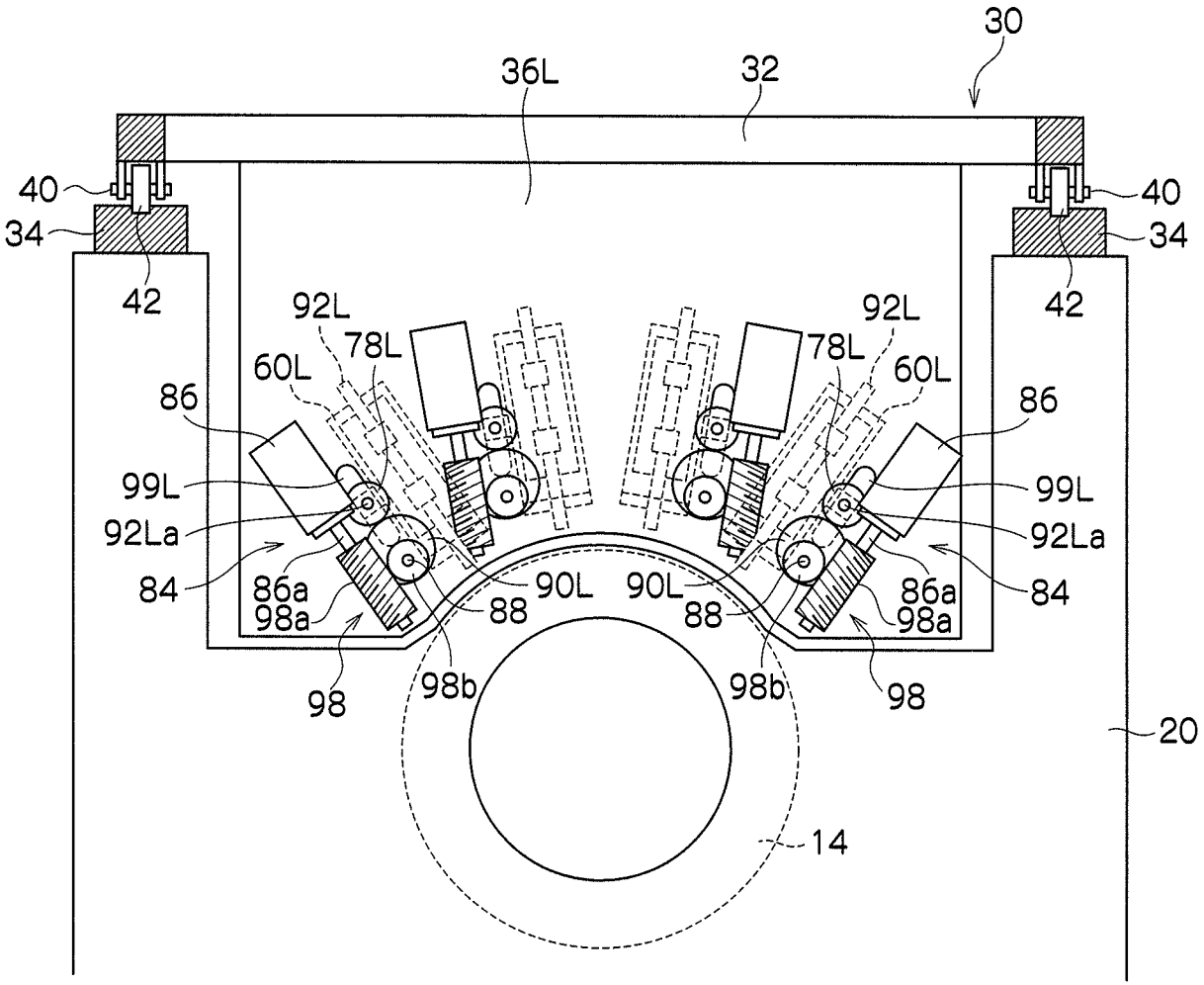
FIG. 16 is a view along arrow 16-16 in FIG. 12.

FIG. 12 is a front view diagram showing the composition of a mounting platform provided on a carriage. Furthermore, FIGS. 13 to 16 are, respectively, diagrams along line 13-13, line 14-14, line 15-15 and line 16-16 in FIG. 12.

The slide supporting mechanisms 76L, 76R include guide rails 78L, 78R, a set of sliders 80La, 80Lb, 80Ra, 80Rb which slide on the guide rails 78L, 78R, and attachment plates 82L, 82R which are attached to the sliders 80La, 80Lb, 80Ra, 80Rb.

The guide rails 78L, 78R are attached to the inner side of the side plates 36L, 36R, and arranged in a straight line passing through the center of the image formation drum 14 (along a normal to the image formation drum 14).

The sliders 80La, 80Lb, 80Ra, 80Rb are provided slidably on the guide rails 78L, 78R. Consequently, the sliders 80La, 80Lb, 80Ra, 80Rb slide along a straight line passing through the center of the image formation drum 14.

The attachment plates 82L, 82R are formed in a square plate shape and are fixed to the sliders 80La, 80Lb, 80Ra, 80Rb by bolts, which are not illustrated. The attachment plates 82L, 82R which are attached to the sliders 80La, 80Lb, 80Ra, 80Rb are disposed perpendicularly with respect to the rotating axle 18 of the image formation drum 14. The attachment plates 82L, 82R slide along a straight line passing through the center of the image formation drum 14 by means of the sliders 80La, 80Lb, 80Ra, 80Rb. The mounting platforms 60L, 60R are attached to the attachment plates 82L, 82R. In other words, the slide sections 60LA, 60RA of the mounting platforms 60L, 60R are fixed by bolts (not illustrated) and attached to the attachment plates 82L, 82R.

The mounting platforms 60L, 60R attached to the attachment plates 82L, 82R are supported slidably along a straight line passing through the center of the image formation drum 14, and are supported raisably and lowerably in a perpendicular direction with respect to the outer circumferential surface of the image formation drum 14. The mounting platforms 60L, 60R which are supported raisably and lowerably in this way are driven to be raised or lowered by an elevator drive mechanism 84.

The elevator drive mechanism 84 is mainly constituted by a pulse motor 86, a rotation drive shaft 88 which is driven to rotate by this pulse motor 86, a pair of left and right-hand eccentric cams 90L, 90R which are installed on the rotation drive shaft 88, and a pair of left and right-hand idle cams 92L, 92R which are installed on the attachment plates 82L, 82R and are also abutted against the eccentric cams 90L, 90R.

The pulse motor 86 is installed via a bracket 94 on an outer side surface of one side plate 36L, and the output shaft 86*a* thereof is provided perpendicularly with respect to the rotating axle 18 of the image formation drum 14.

The rotation drive shaft 88 is provided so as to span between the left and right side plates 36L, 36R, and is arranged in parallel with the rotating axle 18 of the image formation drum 14. The rotation drive shaft 88 is supported rotatably on bearings 96L, 96R provided on the left and right side plates 36L, 36R.

The rotation of the pulse motor 86 is transmitted to the rotation drive shaft 88 by a worm gear 98. A worm thread 98*a* constituting the worm gear 98 is attached to the output shaft 86*a* of the pulse motor 86. On the other hand, a worm wheel 98*b* which meshes with the worm 98*a* is installed on the rotation drive shaft 88. By this means, the rotation of the pulse motor 86 is transmitted to the rotation drive shaft 88.

The pair of left and right-hand eccentric cams 90L, 90R are formed in a circular disk shape, and are installed on the rotation drive shaft 88 with eccentrically set centers of rotation. The eccentric cams 90L, 90R are respectively arranged to the outer side of the side plates 36L, 36R, and are disposed perpendicularly with respect to the rotating axle 18 of the image formation drum 14.

The idle cams 92L, 92R are formed in a circular disk shape and are mounted on the eccentric cams 90L, 90R in such a manner that the circumferential surfaces thereof abut against the circumferential surfaces of the eccentric cams 90L, 90R. The idle cams 92L, 92R are supported rotatably on supporting axles 92La, 92Ra which are provided in parallel with the rotating axle 18 of the image formation drum 14.

The supporting axles 92La, 92Ra are arranged in parallel with the rotating axle 18 of the image formation drum 14, via elongated holes 99L, 99R which are formed in the side plates 36L, 36R. The base end sections are fixed to the axle supporting sections 82La, 82Lb which are formed in an integrated fashion with the attachment plates 82L, 82R.

The elongated holes 99L, 99R are formed in parallel with the guide rails 78L, 78R. By this means, the idle cams 92L, 92R are provided movably along the guide rails 78L, 78R.

According to the elevator drive mechanism 84 which is composed in this way, when the pulse motor 86 is driven and the rotation drive shaft 88 turns, the pair of left and right-hand eccentric cams 90L, 90R rotate. By this means, the idle cams 92L, 92R are raised and lowered perpendicularly with respect to the outer circumferential surface of the image formation drum 14. By raising and lowering the idle cams 92L, 92R, the attachment plates 82L, 82R which are coupled to the idle cams 92L, 92R are raised and lowered, as a result of which the mounting platforms 60L, 60R are raised and lowered perpendicularly with respect to the outer circumferential surface of the image formation drum 14.

As described above, the mounting platforms 60L, 60R included in the carriage 30 are provided raisably and lowerably with respect to the outer circumferential surface of the image formation drum 14. The line head 16 is installed on the carriage 30 by mounting the left and right-hand flange sections 62L, 62R thereof on the mounting platforms 60L, 60R.

The line head 16 mounted on the carriage 30 is moved between the image forming position and the maintenance position (standby position) by moving the carriage 30 along the rails 42.

Here, the image formation position is set to the position where the image formation drum 14 is disposed, and the maintenance position is set to the position where the maintenance unit 100 is disposed. The image formation position referred to here corresponds to a "first position" and the maintenance position corresponds to a "second position".

When moved to the image formation position, the respective line heads 16C, 16M, 16Y, 16K are arranged about the periphery of the image formation drum 14, facing the image formation drum 14.

On the other hand, when moved to the maintenance position, the line heads 16C, 16M, 16Y, 16K are arranged over a maintenance unit 100. This maintenance unit 100 is a unit which carries out maintenance of the line heads 16C, 16M, 16Y, 16K, and has a waste liquid tray, a cap, and the like.

When they are to be moved, the line heads 16C, 16M, 16Y, 16K are raised to a prescribed movement position and then moved while situated in this movement position. In other words, the mounting platforms 60L, 60R on which the line heads 16C, 16M, 16Y, 16K are mounted are raised to a prescribed withdrawal position, and are moved while the state where the line heads 16C, 16M, 16Y, 16K are withdrawn is kept.

When the line heads 16C, 16M, 16Y, 16K have been moved to the image formation position, they are then lowered by a prescribed amount from the movement position and set in a position which enables image formation. This position which enables image formation corresponds to the "droplet ejection position".

Furthermore, when the line heads 16C, 16M, 16Y, 16K have been moved to the maintenance position, they are also lowered from the movement position, as necessary, and set in a position which enables maintenance.

If the line heads 16C, 16M, 16Y, 16K are provided detachably on the carriage 30 in this way and the carriage 30 is also provided movably, then when vibration occurs in the main body frame 20, this vibration is transmitted to the line heads 16C, 16M, 16Y, 16K and the line heads 16C, 16M, 16Y, 16K vibrate. As a result of this, droplet ejection accuracy falls and printing quality declines. Furthermore, vibration non-uniformity occurs based on the spatial distance of the nozzle arrangement and the vibration frequency, as explained in relation to FIG. 29 to FIG. 34.

Therefore, a locking mechanism which fixes the line heads 16C, 16M, 16Y, 16K to the main body frame 20 at the position which enables image formation is provided in the inkjet recording apparatus according to the present embodiment, thereby preventing the occurrence of vibration. Furthermore, a mechanism which suppresses the occurrence of vibration is adopted for fixing devices which attach the image formation drum 14 and the transfer drums 26, 28, and so on, to the main body frame 20.

Head Locking Mechanism

As shown in FIG. 9 and FIG. 12, the locking mechanism of the line heads is constituted by a carriage locking apparatus 110 which locks the carriage 30 to the main body frame 20 (this corresponds to a "carriage fixing device") and a line head locking mechanism 120 which locks the line heads 16C, 16M, 16Y, 16K to the carriage 30 which has been locked to the main body frame 20.

The carriage locking apparatus 110 is constituted by an electromagnet 112 which is provided with the ceiling frame 34 and a magnetic bracket 114 which is provided with the carriage 30.

The electromagnet 112 is disposed on the ceiling frame 34 via an electromagnet installation plate 116. The electromagnet installation plate 116 is formed in a rectangular plate shape and is erected perpendicularly with respect to the upper surface section of the ceiling frame 34, as well as being arranged perpendicularly with respect to the rails 42. A plurality of electromagnets 112 (in the present embodiment, four electromagnets 112) are provided at uniform intervals apart on the electromagnet installation plate 116.

A catch plate 118 is installed on the front end of the electromagnets 112. The catch plate 118 is constituted by a magnetic body and is formed in a rectangular plate shape.

The magnetic bracket 114 is constituted by a magnetic body and is formed in a rectangular plate shape. This magnetic bracket 114 is installed on the end face of the carriage main body 32 by bolts, which are not illustrated. The magnetic bracket 114 installed on the carriage main body 32 is arranged so as to face the catch plate 118.

According to the carriage locking apparatus 110 which is composed as described above, when the carriage 30 is move to the image formation position, the magnetic bracket 114 abuts against the catch plate 118. When the electromagnets 112 are switched on in this state, the magnetic bracket 114 is magnetically attracted to the catch plate 118, and the carriage 30 is fixed in an integrated fashion to the ceiling frame 34. The ceiling frame 34 is fixed to the main body frame 20, and therefore the carriage 30 is ultimately fixed to the main body frame 20.

The line head locking mechanism 120 is constituted by a pressing roller 122 which is installed on the main body frame 20 and a cam 124 which is attached to each line head 16 (16C, 16M, 16Y, 16K).

The pressing roller 122 is arranged so as to correspond to each line head 16, and is installed via bearings 126 on the main body frame 20. The pressing roller 122 which is installed on the main body frame 20 is supported rotatably about an axis parallel to the nozzle surface of the corresponding line head 16. Furthermore, the pressing roller 122 (which corresponds to a "rotating body") is arranged so as to oppose the plate spring 66 (which corresponds to a "head fixing pressure application device") which is provided on one mounting platform 60R.

The cam 124 is formed in a wedge shape constituted by an inclined section 124A (which corresponds to an "inclined cam surface") and a flat section 124B. This cam 124 is installed on one end of the width direction of each line head 16 (one end on the pressing roller 122 side). The cam 124 provided on the side surface section of each line head 16 is arranged so as to project downward from the nozzle surface, and is also arranged perpendicularly with respect to the nozzle surface. Furthermore, when the line heads 16 are mounted on the mounting platforms 60L, 60R, the inclined section 124A is arranged so as to abut against the outer circumferential surface of the pressing roller 122.

According to the line head locking mechanism 120 which is composed in this way, when the line heads 16 are mounted on the mounting platforms 60L, 60R, the inclined section 124A of the cam 124 provided with the line heads 16 abut against the outer circumference of the pressing roller 122. When the mounting platforms 60L, 60R are lowered in this state, the cam 124 is pressed by the pressing roller 122 and the line heads 16 move in a direction away from the pressing roller 122 along the rotating axle 18 of the image formation drum 14.

Here, the plate spring 66 is provided on the mounting platform 60R which is located in the direction in which the line heads 16 are pressed and moved by the pressing roller 122, and the line heads 16 are impelled in the direction towards the pressing roller 122 by this plate spring 66.

As a result of this, the line heads 16 are gripped by the plate spring 66 and the pressing roller 122, and are fixed (constricted) in an integrated fashion to the carriage 30.

If the impelling force of the plate spring 66 is too strong (in the spring constant is too high), then the fixing of the carriage 30 by the carriage locking apparatus 110 is released, and therefore the plate spring 66 is set to a spring constant which impels the line heads 16 with a smaller force than the holding force of the carriage 30 by the electromagnets 112.

Furthermore, the pressing roller 122 is composed in such a manner that the pressing roller 122 rises up on the flat section 124B of the cam 124, when the line heads 16 are lowered by a prescribed amount, and the line heads 16 do not move lowered further than this. By this means, it is possible to keep the heads in the same position in the width direction at all times.

Action

The image formation unit which is composed as described above has the following action.

The line heads 16 (16C, 16M, 16Y and 16K) are installed on the carriage 30 as described below.

Firstly, the mounting platforms 60L, 60R are moved to a prescribed standby position, and in this state, the carriage 30 is moved to the maintenance position.

Next, the line heads 16 are mounted on the mounting platforms 60L, 60R. In other words, the flanges 62L, 62L formed on either end of the width direction of each line head 16 are mounted on the mounting sections 60LB, 60LA of the mounting platforms 60L, 60R. By this means, each line head 16 is mounted on the carriage 30.

Since rollers 64L, 64R are provided on the mounting sections 60LB, 60RB of the mounting platforms 60L, 60R (see FIG. 11), then the line heads 16 mounted on the mounting platforms 60L, 60R are supported movably in the width direction (the direction of the rotating axle 18 of the image formation drum 14).

When the line heads 16 are mounted on the carriage 30, the carriage 30 is then moved to the image formation position. When the carriage 30 is moved to the image formation position, the line heads 16 are arranged about the periphery of the image formation drum 14.

Furthermore, when the carriage 30 reaches the image formation position, the magnetic bracket 114 provided with the carriage 30 abuts against the catch plate 118 provided on the ceiling frame 34. In this state, the electromagnets 112 are switched on, and the magnetic bracket 114 is attracted and attached magnetically to the catch plate 118. By this means, the carriage 30 is fixed to the ceiling frame 34.

When the carriage 30 has been locked by the electromagnets 112, the pulse motor 86 which raises and lowers the mounting platforms 60L, 60R is driven, and the mounting platforms 60L, 60R are lowered toward the image formation drum 14. By this means, the line heads 16 are lowered toward the image formation drum 14.

Figure 17A:
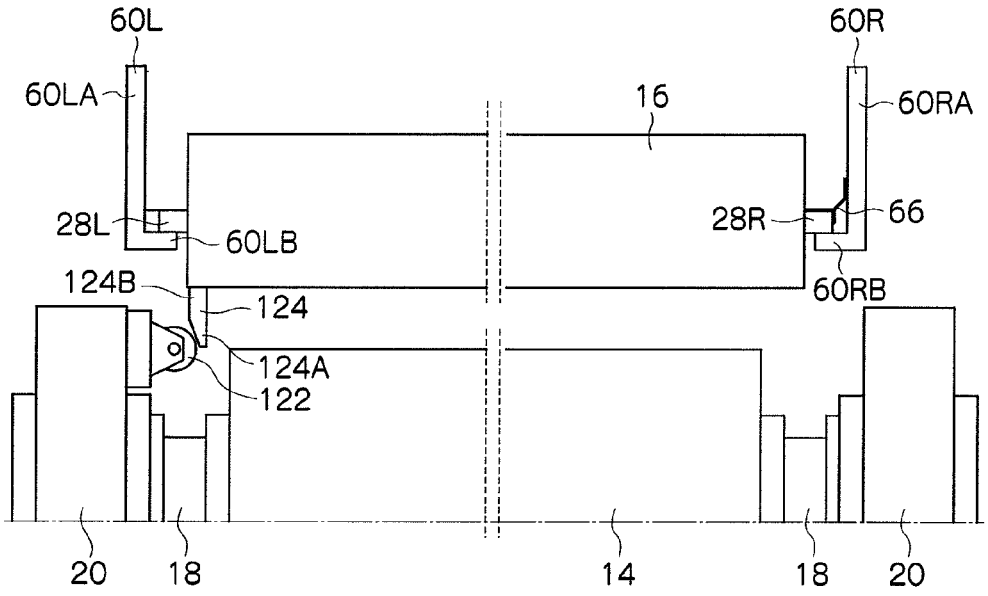
FIG. 17A and FIG. 17B are illustrative diagrams of the action of a line head locking mechanism.
Figure 17B:
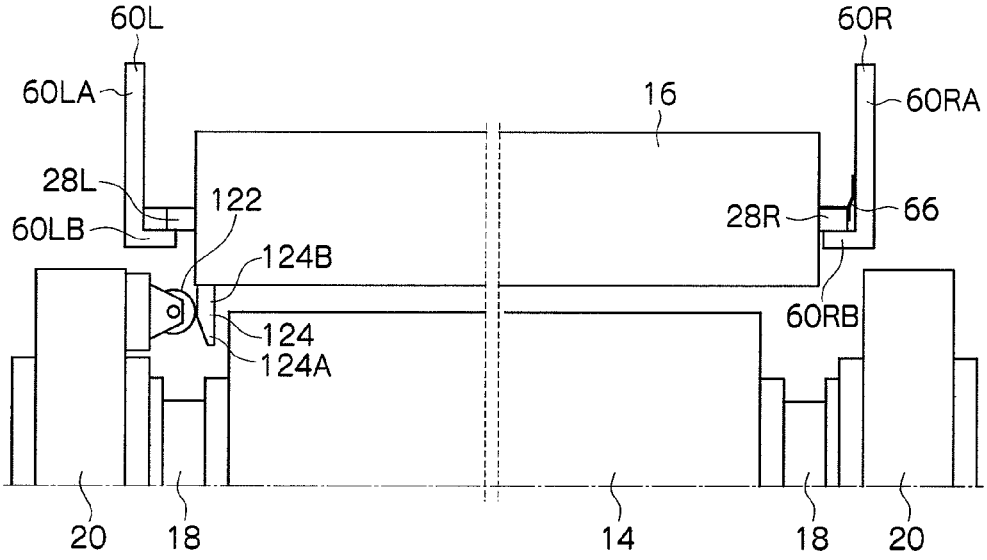

When the line heads 16 are lowered towards the image formation drum 14, as shown in FIGS. 17A and 17B, the cam 124 is pressed by the pressing roller 122.

Here, as described above, the line heads 16 are supported movably in the width direction (the direction of the rotating axle 18 of the image formation drum 14) by the rollers 64L, 64R which are provided with the mounting platforms 60L, 60R, and therefore when the cam 124 is pressed by the pressing roller 122, they move in a direction away from the pressing roller 122 in the direction of the rotating axle 18 of the image formation drum 14.

On the other hand, since a plate spring 66 is arranged on the mounting platform 60R which is situated on the opposite side to the pressing roller 122, then if the line heads 16 are moved away from the pressing roller 122, the line heads 16 are impelled toward the pressing roller 122 by the plate spring 66. As a result of this, the line heads 16 are gripped by the plate spring 66 and the pressing roller 122, and are fixed in an integrated fashion to the carriage 30.

Since the carriage 30 is coupled in an integrated fashion with the main body frame 20, the line heads 16 are fixed in an integrated fashion with the main body frame 20, in a state where pressure is applied thereto by the plate spring 66.

The throw distance of the line heads 16 is adjusted by adjusting the amount of lowering of the heads, and lowering of the heads is halted when the prescribed throw distance is obtained. By this means, it becomes possible to carry out printing.

Thereafter, printing is started and a printing process is carried out onto the paper 12 which is supplied in continuous fashion.

In this, vibration occurs in the image formation drum 14 due to the driving, and this vibration is also transmitted to the main body frame 20, but in the inkjet recording apparatus according to the present embodiment, since the line heads 16 are fixed to the main body frame 20, then it is possible to synchronize the drive vibration caused by conveyance of the paper and the vibration transmitted to the line heads 16. As a result of this, it is possible to prevent reduction in the deposition accuracy (to not greater than 2 to 3 μm), and it is possible to form an image of high quality.

Furthermore, the line heads 16 are fixed to the main body frame 20 by the operation of lowering the heads to a prescribed position, and therefore the line heads 16 can be positioned and fixed accurately by means of a simple structure.

Example 1 of Drum Axle Fixing Structure

Figure 18:
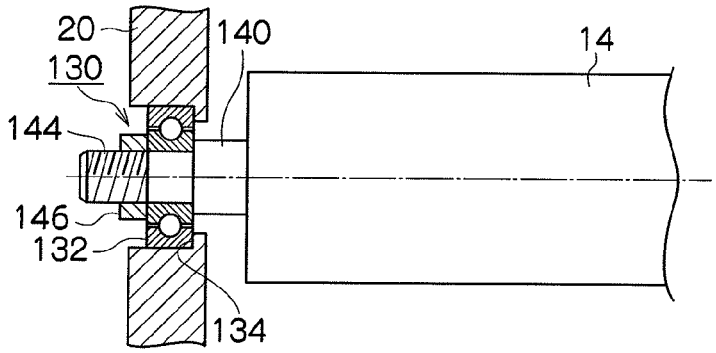
FIG. 18 is a diagram showing a first example of a drum axle fixing structure.

FIG. 18 is a cross-sectional diagram showing a first example of a drum axle fixing structure. Here, the description takes the image formation drum 14 as an example, but an axle fixing structure of the same sort is also adopted for other drums and rollers, such as the transfer drums 26, 28, and the like.

As shown in FIG. 18, a step section (recess section) 134 which accommodates a bearing 132 is formed in an opening section 130 of the main body frame 20, and a ring-shaped bearing 132 is provided in this step section 134. The bearing 132 is fixed by heat and pressure fitting into the step section 134 of the main body frame 20. The bearing 132 functions as a bearing for rotatably supporting the rotating axle (drum axle) 140 of the image formation drum 14. A screw section 144 is formed in the end portion of the drum axle 140 which passes through the bearing 132. A fastening screw 146 is fastened into this screw section 144, and an inner ring 133 of the bearing 132 is gripped and fixed between the main body frame 20 and the fastening section 146. Due to the fastening action of the fastening screw 146, the image formation drum 14 is fixed in a state where pressure is applied in the axial direction. Although not shown in FIG. 18, an axle fixing mechanism of the same sort is also used for the other end portion of the image formation drum 14.

By means of a fixing mechanism of this kind, it is possible to fix the axle while restricting play between the main body frame 20 and the image formation drum 14, to a minimum.

Example 2 of Drum Axle Fixing Structure

Figure 19:
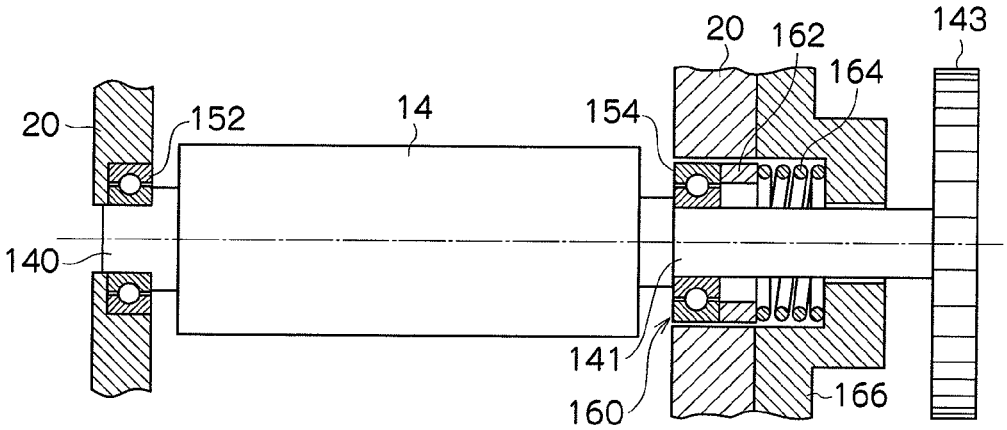
FIG. 19 is a diagram showing a second example of a drum axle fixing structure.

FIG. 19 is a diagram showing a second example of a drum axle fixing structure. In FIG. 19, one end portion (the left-hand side in FIG. 19) of the rotating axle 140 of the image formation drum 14 is installed on the main body frame 20 via a bearing 152. The bearing 152 is fixed by heat and pressure fitting to the main body frame 20.

The other end portion of the image formation drum 14 (the right-hand side in FIG. 19) is installed on the main body frame 20 via a bearing 154. The bearing 154 is arranged in the opening section 160 of the main body frame 20, and the drum axle 141 is supported rotatably in this bearing 154. A gear 143 for transmitting drive force for causing the image formation drum 14 to rotate is provided in the end portion of the drum axle 141. This gear 143 corresponds to a gear wheel which is indicated by reference numeral 520 in FIG. 22.

Furthermore, as shown in FIG. 19, a sleeve 162 is arranged to abut against the outer ring of the bearing 154, and a pressure spring 164 (which corresponds to a "pressure application device for fixing conveyance unit") is arranged in contact with this spring 162. In order to fix one end of the pressure spring 164, a pressure cover 166 is fixed to the main body frame 20. The pressure cover 166 is connected in an integrated fashion to the main body frame 20, by bolts (not illustrated).

By means of a composition of this kind, pressure in the drum axis direction is applied between the main body frame 20 and the image formation drum 14, by the pressure spring 164, and the image formation drum 14 is fixed to the main body frame 20 in a state where play in the axial direction is restricted to a minimum.

Optimization of x-Direction Relative Vibration Period Between Line Head and Image Formation Drum, and Spatial Distance of Nozzle Arrangement By means of the composition of the locking mechanism described in relation to FIG. 8 to FIG. 17B, and the drum axle fixing structure described in relation to FIG. 18 to FIG. 19, the amplitude of relative vibration in the x direction between the head unit and the drum is restricted to the order of several μm. There are limits on the extent to which the amount of vibration of the vibration generating source which is the main cause of vibration non-uniformity can be reduced, and therefore vibration non-uniformity is reduced by optimizing the relationship between the vibration period and the nozzle arrangement, which is the subsidiary cause. More specifically, an appropriate relationship is set between the vibration period Pv on the paper which is determined by the intrinsic vibration period fv and the relative scanning speed vp (see "Formula 1"), and the resonance frequency of the line head 16.

Figure 20:
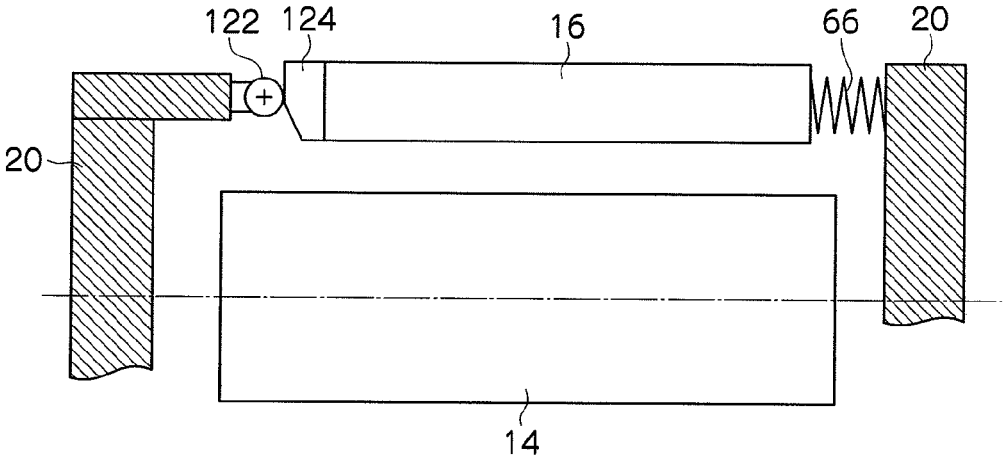
FIG. 20 is a schematic drawing showing a line head pressure fixing structure.

As described in relation to FIG. 9 to FIG. 17B, the line heads 16 are fixed to the main body frame 20 via a pressure spring (plate spring 66). FIG. 20 is a schematic drawing thereof.

When the mass of the line head 16 is represented by $m_1$, and the spring constant of the pressure spring (plate spring 66) is represented by $k_1$, then the intrinsic frequency of the vibration (resonance frequency), $f_1$, is expressed by $f_1=(2\pi)^{-1}\times(k_1/m_1)^{1/2}$.

$m_1$ and $k_1$ are designed in such a manner that this resonance frequency $f_1$ is different from the spatial distance of the nozzle arrangement (the y-direction offset amount in the nozzle joint section), and the actual vibration period which is specified by the paper conveyed speed (the frequency of the dark/light pitch which appears on the recording medium).

Similarly, in the conveyance unit described in relation to FIG. 19 (image formation drum 14, and the like), when the mass of the drum is represented by $m_2$, and the spring constant of the pressure spring is represented by $k_2$, then the intrinsic frequency of the vibration in the axial direction (the resonance frequency), $f_2$, is expressed by $f_2=(2\pi)^{-1}\Delta(k_2/m_2)^{1/2}$.

$m_2$ and $k_2$ are designed in such a manner that this resonance frequency $f_2$ is different from the spatial distance of the nozzle arrangement (the y-direction offset amount in the nozzle joint section), and the actual vibration period which is specified by the paper conveyed speed (the frequency of the dark/light pitch which appears on the recording medium).

Countermeasures Taking Account of Subsidiary Cause

More specifically, the apparatus is composed in such a manner that the relationship between the vibration period Pv (see "Formula 1") on the paper which is determined by the intrinsic vibration period fv and the relative scanning speed vp, and the offset amount OSy of a "y-offset adjacent nozzle pair" determined by the nozzle arrangement conforms to or is close to condition [1] in Table 1.

In other words, the apparatus is composed in such a manner that the relationship in Relationship 1 below is satisfied.

$$OSy \approx k \times Pv \qquad \text{Relationship 1}$$

(where k is a natural number.)

This can be rewritten as following Relationship 1', using Formula 1.

$$OSy \approx k \times vp/fv \qquad \text{Relationship 1'}$$

(where k is a natural number.)

On the other hand, from Formula 3, ΔDmax can take a value from 0 to 2Av. The extent of the effect in reducing non-uniformity varies depending on the value of ΔDmax, and the smaller the value of ΔDmax, the greater the extent to which deterioration of the image quality caused by non-uniformity is suppressed. Considering the fact that the x-direction amplitude of the relative vibration produced at a period corresponding to the intrinsic vibration period fv and the relative scanning speed vp is Av, then from the viewpoint of obtaining an effect in reducing vibration non-uniformity to a desirable and practicable level, desirably, ΔDmax is not greater than Av/2 and more desirably, not greater than Av/4.

In other words, from Formula 3, it is desirable to satisfy Relationship 2 below.

$$|\sin\{\pi \cdot OSy/Pv\}| \leq 1/4 \qquad \text{Relationship 2}$$

More desirably, Relationship 3 indicated below is satisfied.

$$|\sin\{\pi \cdot OSy/Pv\}| \leq 1/8 \qquad \text{Relationship 3}$$

These Relationships 2 and 3 can be rewritten respectively using Formula 1, as the following Relationships 2' and 3'.

$$|\sin\{\pi \cdot OSy \cdot fv/vp\}| \leq 1/4 \qquad \text{Relationship 2'}$$

$$|\sin\{\pi \cdot OSy \cdot fv/vp\}| \leq 1/8 \qquad \text{Relationship 3'}$$

In the case of the nozzle arrangement of two rows by N columns illustrated in FIG. 29, the offset amount OSy of the y-offset adjacent nozzle pair is a uniform value, but there are also cases where the offset amount of the y-offset adjacent nozzle pair is a different value, as in the nozzle arrangement of six rows by N columns shown in FIG. 32. In other words, the offset amount between the nozzles of the first row (bottommost row) and the nozzles of the second row is 100 pix, and the offset amounts between the second row and the third row, the third row and the fourth row, and the fourth row and the fifth row are respectively 100 pix, but the offset amount between the sixth row and the first row is 500 pix.

If there are y-offset adjacent nozzle pairs which have different offset amounts in this way, then it is not absolutely necessary to adopt a composition which satisfies Relationship 1, Relationship 2 or Relationship 3 in respect of all of the different offset amounts. The greater the offset amount of the nozzle pair, the greater their effect on vibration non-uniformity, and therefore a suitable effect is obtained provided that a composition is adopted whereby Relationships 1, 2, or 3 are satisfied in respect of the maximum value of the offset amount at least. In actual practice, in the case of the nozzle arrangement in FIG. 32, a sufficient effect in improving image quality was observed if the Relationship 1, 2 or 3 is satisfied by taking OSy to be the offset amount (=500 pix) of the nozzle pair constituted by a nozzle of the first row (bottommost row) and a nozzle of the sixth row (uppermost row) which form adjacent dots in the x direction.

Example of Composition of Inkjet Recording Apparatus

Next, an example of the overall composition of an inkjet recording apparatus using the technology described in relation to FIG. 1 to FIG. 20 will be described.

Figure 21:
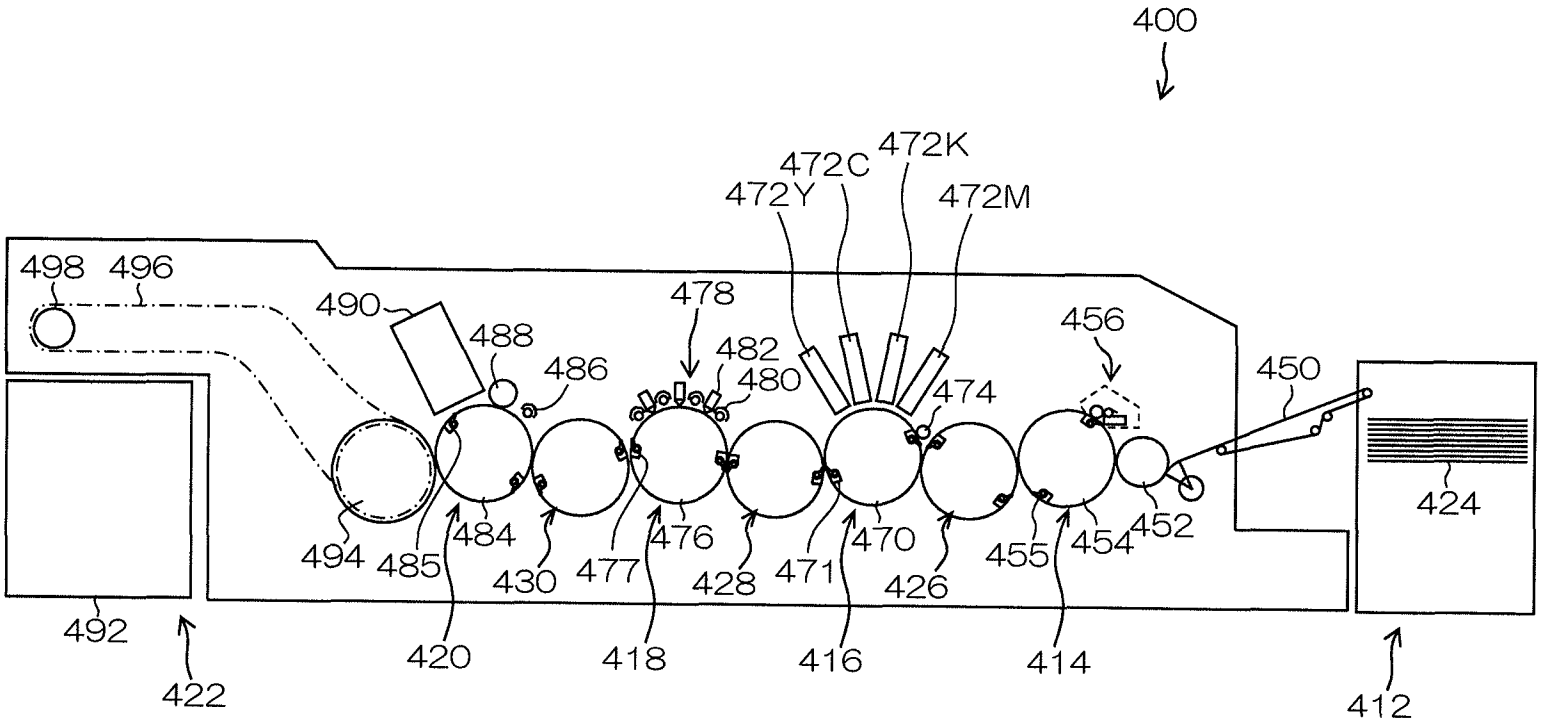
FIG. 21 is a general schematic drawing of an inkjet recording apparatus relating to an embodiment of the present invention.
Figure 22:
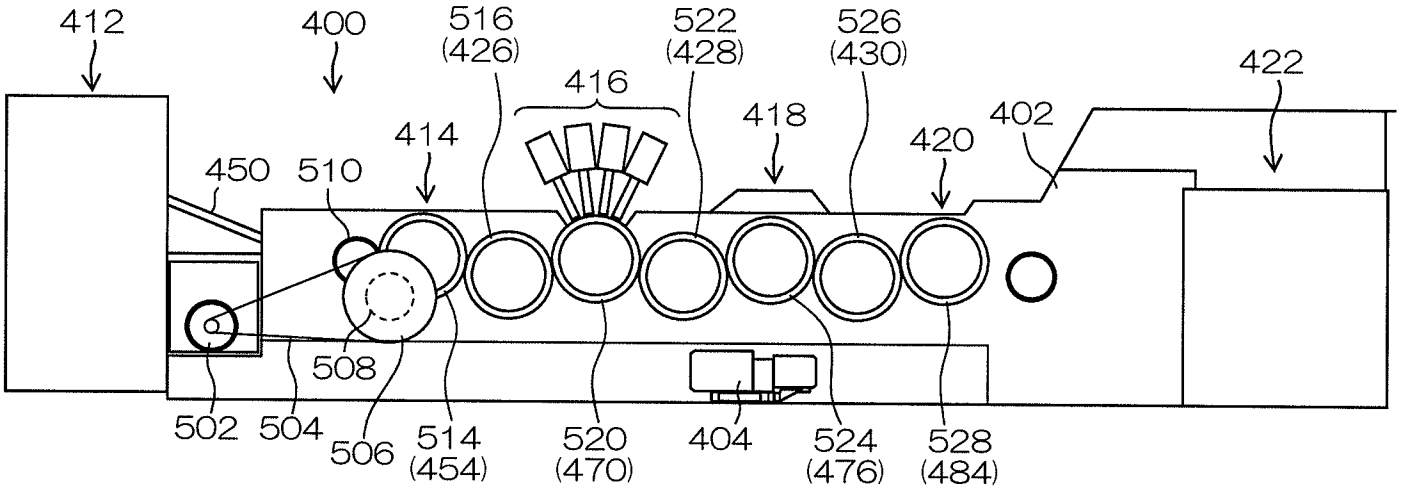
FIG. 22 is a schematic drawing of a drum rotation mechanism in the inkjet recording apparatus shown in FIG. 21.

FIG. 21 is a general schematic drawing showing an example of the composition of an inkjet recording apparatus relating to an embodiment of the present invention. FIG. 22 is a schematic drawing of a drum rotation drive mechanism which is provided on a side face on the opposite side to FIG. 21. As shown in these drawings, the inkjet image recording apparatus 400 according to the present embodiment is principally constituted by a paper supply unit 412, a treatment liquid deposition unit (pre-coating unit) 414, an image formation unit 416, a drying unit 418, a fixing unit 420 and a paper output unit 422. The inkjet recording apparatus 400 is an inkjet image recording apparatus using a single pass method, which forms a desired color image by ejecting droplets of inks of a plurality of colors from long inkjet heads 472M, 472K, 472C and 472Y onto a recording medium 424 (called "paper" below for the sake of convenience) held on a pressure drum (image formation drum 470) of an image formation unit 416. The inkjet recording apparatus 400 is an image forming apparatus of an on-demand type employing a two-liquid reaction (aggregation) method in which an image is formed on a recording medium 424 by depositing a treatment liquid (here, an aggregating treatment liquid) on the recording medium 424 before ejecting droplets of ink, and causing the treatment liquid and ink liquid to react together.

Paper Supply Unit

A cut sheet recording medium 424 (which corresponds to the "image formation receiving medium") is stacked in the paper supply unit 412, and the recording medium 424 is supplied, one sheet at a time, to the treatment liquid deposition unit 414, from a paper supply tray 450 of the paper supply unit 412. It is possible to use recording media 424 of a plurality of types having different materials and dimensions (paper size). Cut sheet paper (cut paper) is used as the recording medium 424, but it is also possible to adopt a composition in which paper is supplied from a continuous roll (rolled paper) and is cut to the required size.

Treatment Liquid Application Unit

The treatment liquid application unit 414 is a mechanism for applying the treatment liquid to a recording surface of each recording medium 424. The treatment liquid contains a color material aggregating agent for aggregating color materials (pigments in the present embodiment) of the ink applied by the drawing unit 416. Contact between the treatment liquid and the ink facilitates separation of the ink into the color materials and solvent.

The treatment liquid deposition unit 414 comprises a paper supply drum 452, a treatment liquid drum (also called a "pre-coating drum") 454 and a treatment liquid application apparatus 456. The treatment liquid drum 454 includes a hook-shaped gripping device (gripper) 455 provided on the outer circumferential surface thereof, and is devised in such a manner that the leading end of the recording medium 424 can be held by gripping the recording medium 424 between the hook of the holding device 455 and the circumferential surface of the treatment liquid drum 454. The treatment liquid drum 454 may include suction holes provided in the outer circumferential surface thereof, and be connected to a suctioning device which performs suctioning via the suction holes. By this means, it is possible to hold the recording medium 424 tightly against the circumferential surface of the treatment liquid drum 454.

A treatment liquid application apparatus 456 is provided opposing the circumferential surface of the treatment liquid drum 454, to the outside of the drum 454. The treatment liquid application apparatus 456 includes a treatment liquid vessel in which the treatment liquid is stored, an anilox roller which is partially immersed in the treatment liquid in the treatment liquid vessel, and a rubber roller which transfers a dosed amount of the treatment liquid to the recording medium 424, by being pressed against the anilox roller and the recording medium 424 on the treatment liquid drum 454. According to this treatment liquid application apparatus 456, it is possible to apply the treatment liquid to the recording medium 424 while dosing the amount of the treatment liquid.

In the present embodiment, a composition is described which uses a roller-based application method, but the method is not limited to this, and it is also possible to employ various other methods, such as a spray method, an inkjet method, or the like.

The recording medium 424, applied with the treatment liquid from the treatment liquid application unit 414, is delivered from the treatment liquid drum 454 to the drawing drum 470 of the drawing unit 416 via an intermediate conveying unit 426.

Image Formation Unit

The image formation unit 416 includes an image formation drum (also called "jetting drum") 470, a paper pressing roller 474, and inkjet heads 472M, 472K, 472C and 472Y. Similarly to the treatment liquid drum 454, the image formation drum 470 includes a to hook-shaped holding device (gripper) 471 on the outer circumferential surface of the drum.

The recording medium 424 held on the image formation drum 470 is conveyed with the recording surface thereof facing to the outer side, and ink is deposited onto the recording surface of this medium 424 from the inkjet heads 472M, 472K, 472C and 472Y.

The inkjet heads 472M, 472K, 472C and 472Y are each full-line type inkjet recording heads (corresponding to a "liquid ejection head") having a length corresponding to the maximum width of the image forming region on the recording medium 424, and a nozzle row of nozzles for ejecting ink arranged throughout the whole width of the image forming region is formed in the ink ejection surface of each head. The inkjet heads 472M, 472K, 472C and 472Y are each disposed so as to extend in a direction perpendicular to the conveyance direction of the recording medium 424 (the direction of rotation of the image formation drum 470).

The inkjet heads 472M, 472K, 472C and 472Y eject ink droplets of the corresponding colors to the recording surface of the recording medium 424 tightly held on the drawing drum 470. As a result, the ink comes into contact with the treatment liquid that is applied previously to the recording surface by the treatment liquid application unit 414, and consequently the color materials (pigments) dispersed within the ink are aggregated, forming a color material aggregate. This prevents the color materials from flowing on the recording medium 424, and an image is formed on the recording surface of the recording medium 424.

Moreover, although a configuration with the four colors of C, M, Y and K is described in the present embodiment, the combinations of the ink colors and the number of colors are not limited to these. R (red), G (green) or B (blue) inks, light and/or dark inks, and special color inks can be added as required. For example, a configuration is possible in which heads for ejecting light-colored inks, such as light cyan and light magenta, are added, and there is no particular restriction on the arrangement sequence of the heads of the respective colors.

The recording medium 424 on which the image is formed by the drawing unit 416 is then delivered from the drawing drum 470 to a drying drum 476 of the dryer 418 via an intermediate conveying unit 428.

Drying Unit

The drying unit 418 is a mechanism which dries the water content contained in the solvent which has been separated by the action of aggregating the coloring material, and comprises a drying drum 476 and a solvent drying apparatus 478. Similarly to the treatment liquid drum 454, the drying drum 476 includes a hook-shaped holding device (gripper) 477 provided on the outer circumferential surface of the drum, in such a manner that the leading end of the recording medium 424 can be held by the holding device 477.

The solvent drying apparatus 478, disposed so as to face an outer circumference of the drying drum 476, includes halogen heaters 480 and warm air jet nozzles 482 disposed between the halogen heaters 480.

The temperature and volume of the warm air blown from the warm air jet nozzles 482 toward the recording medium 424, as well as the temperature of each halogen heater 480, are adjusted appropriately so as to realize a variety of drying conditions.

The recording medium 424 that has been subjected to the drying process by the dryer 418 is delivered from the drying drum 476 to a fixing drum 484 of the fixing unit 420 via an intermediate conveying unit 430.

Fixing Unit

The fixing unit 420 includes a fixing drum 484, a halogen heater 486, a fixing roller 488 and an in-line sensor 490. Similarly to the treatment liquid drum 454, the fixing drum 484 includes a hook-shaped holding device (gripper) 485 provided on the outer circumferential surface of the drum, in such a manner that the leading end of the recording medium 424 can be held by the holding device 485.

By means of the rotation of the fixing drum 484, the recording medium 424 is conveyed with the recording surface facing to the outer side, and preliminary heating by the halogen heater 486, a fixing process by the fixing roller 488 and inspection by the in-line sensor 490 are carried out in respect of the recording surface.

The fixing roller 488 is a roller member for melting self-dispersing polymer micro-particles contained in the ink and thereby forming a film (covering film) of the ink (i.e. a film is formed), by applying heat and pressure to the dried ink, and is composed so as to heat and pressurize the recording medium 424. More specifically, the fixing roller 488 is disposed so as to contact and press against the fixing drum 484, in such a manner that the fixing roller 488 serves as a nip roller with respect to the fixing drum 484. By this means, the recording medium 424 is sandwiched between the fixing roller 488 and the fixing drum 484 and is nipped with a prescribed nip pressure (for example, at 0.15 MPa), whereby a fixing process is carried out.

Furthermore, the fixing roller 488 is constituted by a heated roller formed by a metal pipe of aluminum, or the like, having good thermal conductivity, which internally incorporates a halogen lamp, and is controlled to a prescribed temperature (for example, 60° C. to 80° C.). By heating the recording medium 424 by means of this heating roller, thermal energy equal to or greater than the Tg temperature (glass transition temperature) of the latex contained in the ink is applied and the latex particles are thereby caused to melt. By this means, fixing is performed by pressing the latex particles into the undulations in the recording medium 424, as well as leveling the undulations in the image surface and obtaining a glossy finish.

The in-line sensor 490 is a measurement device for measuring an ejection defect checking pattern, the image density, image defects, or the like in respect of an image (including a test pattern, and the like) which has been recorded on the recording medium 424; a CCD line sensor, or the like, is employed for the in-line sensor 490.

According to the fixing unit 420 having the composition described above, the latex particles in the thin image layer formed by the drying unit 418 are heated, pressurized and melted by the fixing roller 488, and hence the image layer can be fixed to the recording medium 424. Furthermore, the surface temperature of the fixing drum 484 is set to not less than 50° C. Drying is promoted by heating the recording medium 424 held on the outer circumferential surface of the fixing drum 184 from the rear surface, and therefore breaking of the image during fixing can be prevented, and furthermore, the strength of the image can be increased by the effects of the increased temperature of the image.

Instead of an ink which includes a high-boiling-point solvent and polymer micro-particles (thermoplastic resin particles), it is also possible to use an ink including a monomer which can be polymerized and cured by exposure to UV light. In this case, the inkjet recording apparatus 400 includes a UV exposure unit for exposing the ink on the recording medium 424 to UV light, instead of a heat and pressure fixing unit (fixing roller 488) based on a heat roller. In this way, if using an ink containing an active light-curable resin, such as an ultraviolet-curable resin, a device which radiates the active light, such as a UV lamp or an ultraviolet LD (laser diode) array, is provided instead of the fixing roller 488 for heat fixing.

Paper Output Unit

The paper output section 422 is provided after the fixing unit 420. The paper output unit 422 includes an output tray 492, and a transfer drum 494, a conveyance belt 496 and a tensioning roller 498 are provided between the output tray 492 and the fixing drum 484 of the fixing unit 420 so as to oppose same. The recording medium 424 is sent to the conveyance belt 496 by the transfer drum 494 and output to the output tray 492. The details of the paper conveyance mechanism created by the conveyance belt 496 are not shown, but the leading end portion of a recording medium 424 after printing is held by a gripper of a bar (not illustrated) which spans across the endless conveyance belt 496, and the recording medium is conveyed to above the output tray 492 due to the rotation of the conveyance belts 496.

Furthermore, although not shown in FIG. 21, the inkjet recording apparatus 400 according to the present embodiment includes, in addition to the composition described above, an ink storing and loading unit which supplies ink to the inkjet heads 472M, 472K, 472C and 472Y, and a device which supplies treatment liquid to the treatment liquid deposition unit 414, as well as including a head maintenance unit which carries out cleaning (nozzle surface wiping, purging, nozzle suctioning, and the like) of the inkjet heads 472M, 472K, 472C and 472Y, a position determination sensor which determines the position of the recording medium 424 in the paper conveyance path, a temperature sensor which determines the temperature of the respective units of the apparatus, and the like.

Rotation Drive Mechanism of Drum

As shown in FIG. 22, the inkjet image recording apparatus 400 is provided with a motor (corresponding to a "drive force generating device", called a "drum rotation motor" below) 502, as a source of drive force for the paper conveyance system. The drive force of the drum rotation motor 502 is transmitted to a pulley 506 via a timing belt (an endless toothed belt) 504. A gear wheel 506 is coupled coaxially in an integrated fashion to the pulley 508, and the gear wheel 506 is rotated together with the pulley 508. A gear wheel 510 which meshes with this gear wheel 508 is provided on the upper left-hand side of the gear wheel 508 in FIG. 22, and the gear wheel 510 meshes with a gear wheel 514 which is coupled directly to the end portion of a treatment liquid drum 454 in the pre-coating unit (treatment liquid deposition unit 414). The gear wheel 514 of the treatment liquid drum 454 meshes with a gear wheel 516 which is provided on an end portion of a transfer drum which constitutes the intermediate conveyance unit 426, and this gear wheel 516 meshes with a gear wheel 520 which is provided on an end portion of the image formation drum 470 in the image formation unit 416. Therefore, the gear wheel 520 meshes with a gear wheel 522 of the transfer drum which constitutes the intermediate conveyance unit 428, and also meshes successively with a gear wheel 524 of the drying drum 476, a gear wheel 526 of a transfer drum of the intermediate conveyance unit 430, and a gear wheel 528 of the fixing drum 484.

The gear wheels 514 to 528 are each drum rotating gears, and form a mutually coupled structure. The drive force of the drum rotation motor 502 is transmitted to the gear wheels 514 to 528 via the timing belt 504, the pulley 506, and the gear wheels 508 and 510, and all of the drums (454, 470, 476 and 484) and the transfer drums of the intermediate conveyance units (426, 428, 430) are caused to rotate by the coupled actions of these gear wheels 514 to 528. In the case of the present embodiment, the diameters of the drums (454, 470, 476, 484) and the transfer drums, and the diameters of the gear wheels 514 to 528 (diameter of pitch circle) are matching, and when the treatment liquid drum 454 performs one revolution, the image formation drum 470, the drying drum 476 and the fixing drum 484 also perform one revolution.

Figure 23:
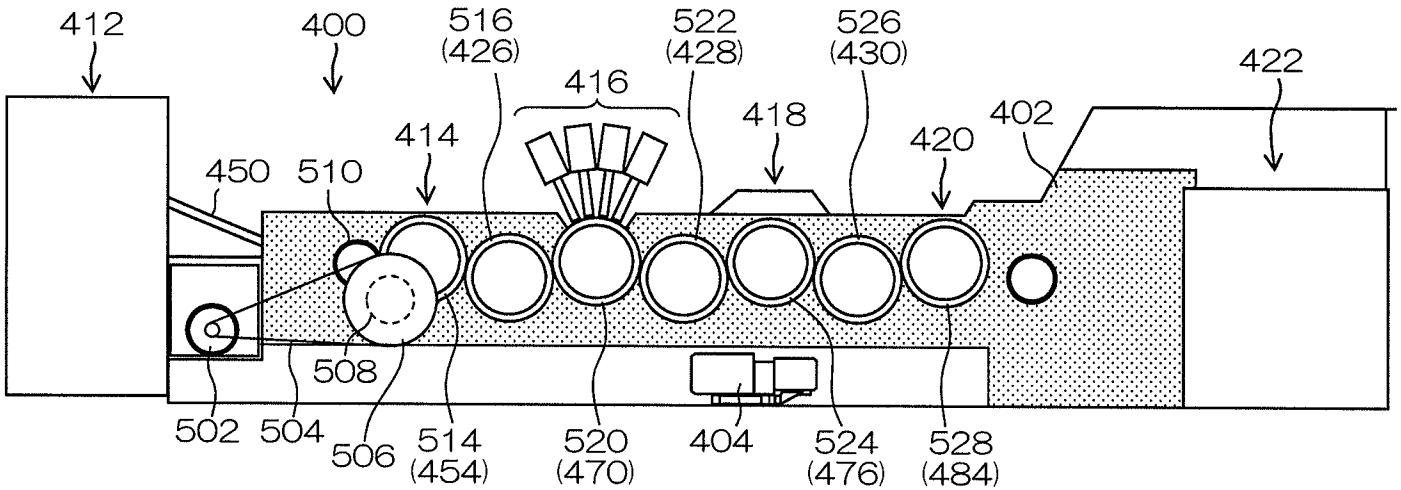
FIG. 23 is an illustrative diagram showing an exaggerated view of the drum supporting frame (side plate) shown in FIG. 21.

The member indicated by reference numeral 402 in FIG. 23 (the member filled with the gray shading) is a side plate which functions as a frame (corresponding to a main body frame) for supporting the drums (454, 470, 476, 484) and the transfer drums of the intermediate conveyance units (426, 428, 430). The members such as the pulley 506, gear wheel 510, drums (454, 470, 476, 484) and intermediate conveyance units (426, 428, 430) are supported rotatably on this side plate 402.

Furthermore, the inkjet recording apparatus 400 comprises a vacuum pump 404 as a device for generating a negative pressure in order to hold a recording medium 424 by suction on the image formation drum 470 and the drying drum 476. In the case of the present embodiment, the vacuum pump 404 is disposed below the drying unit 418. The vacuum pump 404 is connected to exhaust ports of the image formation drum 470 and the drying drum 476 via a tubing system which is not illustrated.

Helical gear wheels are used as the gear wheels of the drive force transmission members which cause the drums 170 to rotate. It is possible to use spur gears for the gear wheels, but in order to achieve a smooth transmission of the drive force, it is desirable to use helical gears, or double helical gears. A helical gear wheel has obliquely formed teeth and is able to achieve smooth transmission of drive force. A double helical gear wheel has a benefit in enabling the force in the thrust direction to be reduced in comparison with a helical gear, but costs more than a helical gear. Consequently, in the present embodiment, a helical gear is used from the viewpoint of achieving both low costs and smooth transmission of drive force. A helical gear may be more liable to produce vibration in the x direction compared to a spur gear, and the present invention can be applied to good effect as a technology for suppressing vibration non-uniformity caused by relative vibration in the x direction.

A composition is adopted whereby the relationship between the intrinsic vibration elements (vibration frequency fv) of the apparatus composition shown in FIG. 21 to FIG. 23, the conveyance speed of the recording medium 424 (the circumferential speed of the image formation drum 470) vp, and the nozzle arrangement of the inkjet heads 472M, 472K, 472C, 472Y, satisfies Relationship 1', Relationship 2' or Relationship 3'.

Guide Value of Vibration Frequency

The inkjet recording apparatus 400 according to the present embodiment is able to record onto recording media (recording paper) up to a maximum of half Kiku size, for example, and uses a drum having a diameter of approximately 500 mm which can handle a recording medium width of 720 mm, for example, as the pressure drum (image formation drum) 470. Furthermore, the ink ejection volume from the inkjet heads 472M, 472K, 472C and 472Y is 2 pl, for example, and the recording density is 1200 dpi, for example, in both the main scanning direction (the width direction of the recording medium 424) and the sub-scanning direction (the conveyance direction of the recording medium 424).

In a system of this kind, if the relative vibration period Pv (y-direction length) is a vibration period in the vicinity of 10 mm, then the effects of non-uniformity are a maximum (the non-uniformity is most conspicuous). If the relative vibration period is sufficiently larger than this, then a phase difference of approximately 10 mm can be ignored, and the visibility of non-uniformity is reduced. Furthermore, conversely, if the relative vibration is vibration of a very high frequency (fine vibration), then the amplitude of the actual vibration becomes small and therefore such vibration does not present a significant problem.

A particular problem in practical terms is posed by vibration which has a period of around 10 mm to 25 mm on the paper. Therefore, in implementing the present invention, it is desirable to employ an apparatus having an intrinsic vibration frequency fv of 10 to 50 Hz. It is even more desirable to employ a system having an intrinsic vibration frequency fv of 20 to 40 Hz.

Example of Composition of Inkjet Head

Next, the structure of the inkjet head will be described. The inkjet heads 472M, 472K, 472C and 472Y corresponding to the respective colors have a common structure, and therefore these heads are represented by a head indicated by the reference numeral 550 below.

Figure 24A:
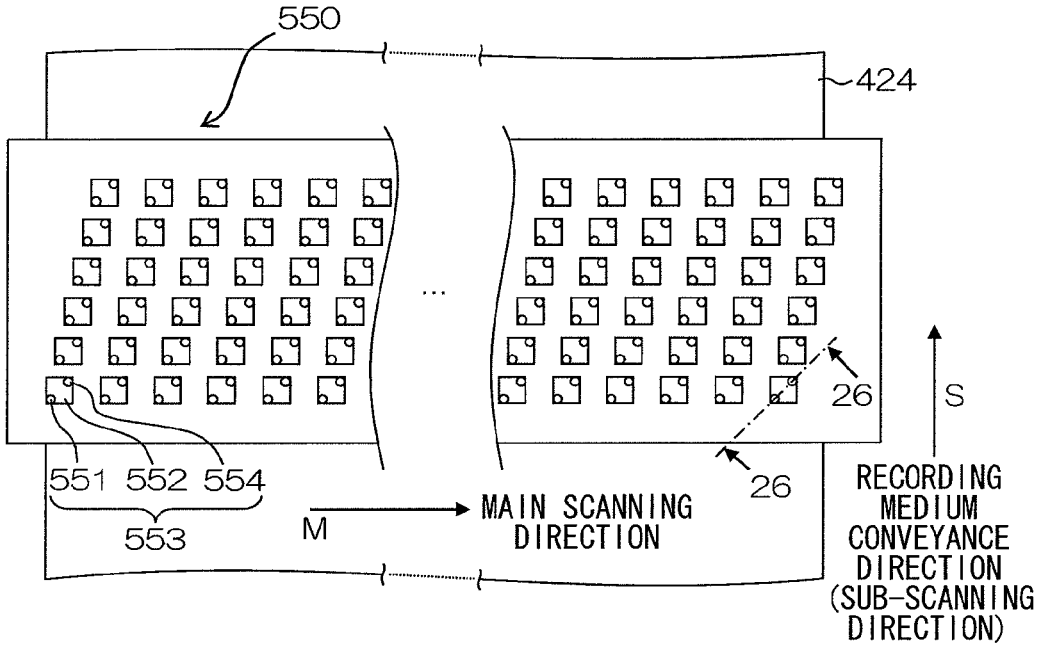
FIGS. 24A and 24B are plan view perspective diagrams showing an example of the composition of an inkjet head.
Figure 24B:
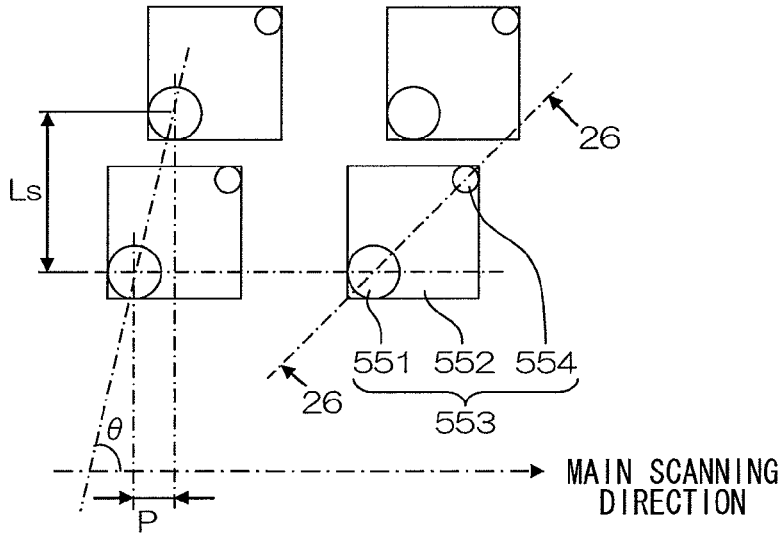
Figure 25A:
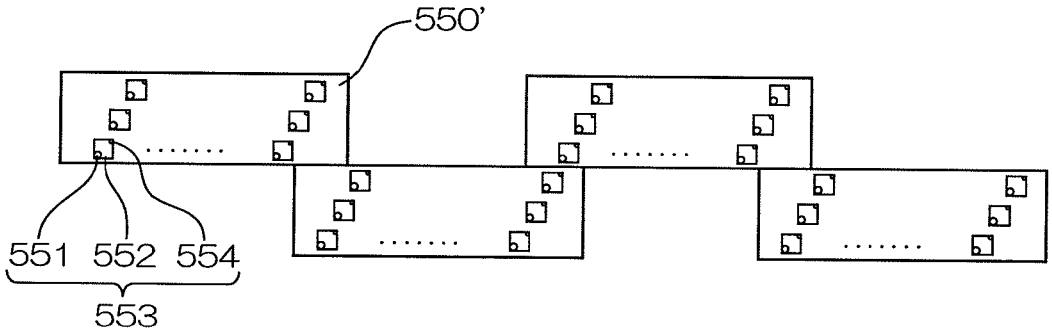
FIGS. 25A and 25B are diagrams showing examples of a head bar composed by joining together a plurality of head modules.
Figure 25B:
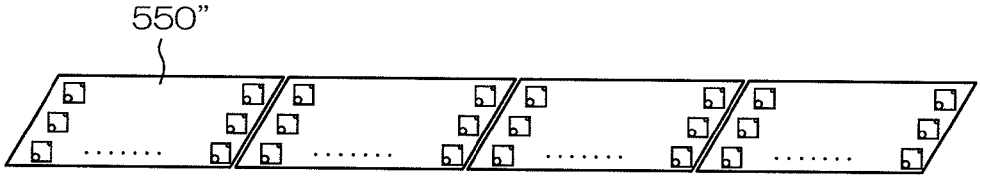
Figure 26:
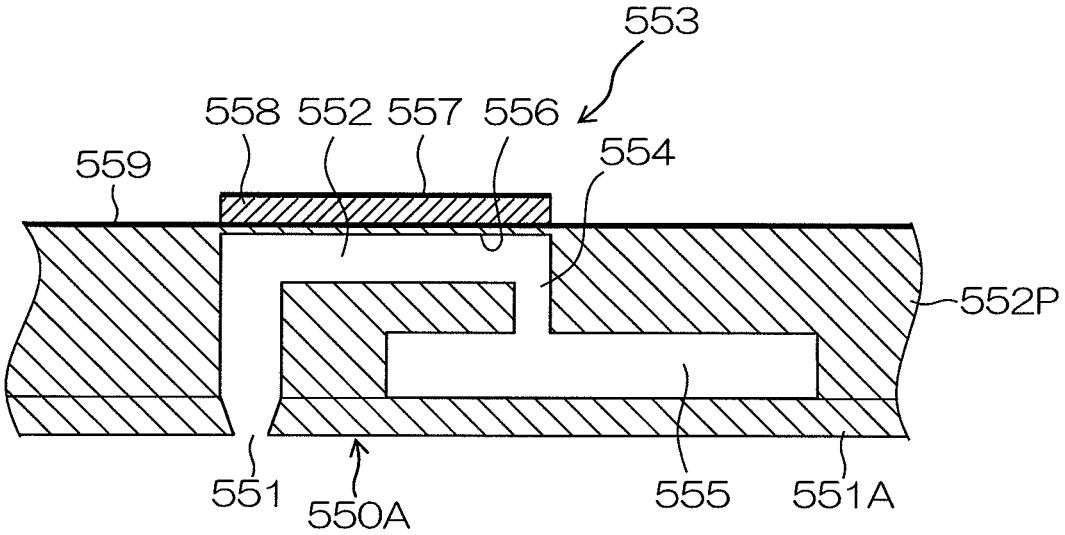
FIG. 26 is a cross-sectional diagram along line 26-26 in FIGS. 24A and 24B.

FIG. 24A is a plan perspective diagram illustrating an embodiment of the structure of a head 550, and FIG. 24B is a partial enlarged diagram of same. Moreover, FIGS. 25A and 25B are planar perspective views illustrating other structural embodiments of the head 550, and FIG. 26 is a cross-sectional diagram illustrating a liquid droplet ejection element for one channel being a recording element unit (an ink chamber unit corresponding to one nozzle 551) (a cross-sectional diagram along line 13-13 in FIGS. 24A and 24B).

As illustrated in FIGS. 24A and 24B, the head 550 according to the present embodiment has a structure in which a plurality of ink chamber units (liquid droplet ejection elements) 553, each having a nozzle 551 forming an ink droplet ejection aperture, a pressure chamber 552 corresponding to the nozzle 551, and the like, are disposed two-dimensionally in the form of a staggered matrix, and hence the effective nozzle interval (the projected nozzle pitch) as projected (orthographically-projected) in the lengthwise direction of the head (the direction perpendicular to the paper conveyance direction) is reduced and high nozzle density is achieved.

The mode of forming nozzle rows which have a length equal to or more than the entire width Wm of the recording area of the recording medium 424 in a direction (direction indicated by arrow M, corresponding to a "second direction") substantially perpendicular to the paper conveyance direction (direction indicated by arrow S, corresponding to a "first direction") of the recording medium 424 is not limited to the embodiment described above. For example, instead of the configuration in FIG. 24A, as illustrated in FIG. 25A, a line head having nozzle rows of a length corresponding to the entire width Wm of the recording area of the recording medium 424 can be formed by arranging and combining, in a staggered matrix, short head modules 550' having a plurality of nozzles 551 arrayed in a two-dimensional fashion. It is also possible to arrange and combine short head modules 550" in a line as shown in FIG. 25B.

The invention is not limited to a case where the full surface of the recording medium 424 is taken as the image formation range, and in cases where a portion of the surface of the recording medium 424 is taken as the image formation region (for example, if a non-image formation region (blank margin portion) is provided at the periphery of the paper, or the like), nozzle rows required for image formation in the prescribed image formation range should be formed.

The pressure chambers 552 provided corresponding to the respective nozzles 551 each have substantially a square planar shape (see FIGS. 24A and 24B), and has an outlet port for the nozzle 551 at one of diagonally opposite corners and an inlet port (supply port) 554 for receiving the supply of the ink at the other of the corners. The planar shape of the pressure chamber 552 is not limited to this embodiment and can be various shapes including quadrangle (rhombus, rectangle, etc.), pentagon, hexagon, other polygons, circle, and ellipse.

As illustrated in FIG. 26, the head 550 is configured by stacking and joining together a nozzle plate 551A in which the nozzles 551 are formed, a flow channel plate 552P in which the pressure chambers 552 and the flow channels including the common flow channel 555 are formed, and the like. The nozzle plate 551A constitutes a nozzle surface (ink ejection surface) 550A of the head 550 and has formed therein the two-dimensionally arranged nozzles 551 communicating respectively to the pressure chambers 552.

The flow channel plate 552P constitutes lateral side wall parts of a pressure chamber 552 and serves as a flow channel formation member which forms a supply port 554 as a limiting part (the narrowest part) of the individual supply channel leading the ink from the common flow channel 555 to a pressure chamber 552. FIG. 26 is simplified for the convenience of explanation, and the flow channel plate 552P may be structured by stacking one or more substrates.

The nozzle plate 551A and the flow channel plate 552P can be made of silicon and formed in the required shapes by means of the semiconductor manufacturing process.

The common flow channel 555 is connected to an ink tank (not shown) which is a base tank for supplying ink, and the ink supplied from the ink tank is delivered through the common flow channel 555 to the pressure chambers 552.

A piezo-actuator 558 having an individual electrode 557 is joined to a diaphragm 556 constituting a part of faces (the ceiling face in FIG. 26) of a pressure chamber 552. The diaphragm 556 in the present embodiment is made of silicon (Si) having a nickel (Ni) conductive layer serving as a common electrode 559 corresponding to lower electrodes of a plurality of piezo-actuators 558, and also serves as the common electrode of the piezo-actuators 558 which are disposed corresponding to the respective pressure chambers 552. The diaphragm 556 can be formed by a non-conductive material such as resin; and in this case, a common electrode layer made of a conductive material such as metal is formed on the surface of the diaphragm member. It is also possible that the diaphragm is made of metal (an electrically-conductive material) such as stainless steel (SUS), which also serves as the common electrode.

When a drive voltage is applied to the individual electrode 557, the piezo-actuator 558 is deformed, the volume of the pressure chamber 552 is thereby changed, and the pressure in the pressure chamber 552 is thereby changed, so that the ink is ejected through the nozzle 551. When the displacement of the piezo-actuator 558 is returned to its original state after the ink is ejected, new ink is refilled in the pressure chamber 552 from the common flow channel 555 through the supply port 554.

As illustrated in FIG. 24B, the plurality of ink chamber units 553 having the above-described structure are arranged in a prescribed matrix arrangement pattern in a line direction along the main scanning direction and a column direction oblique at an angle of θ (not perpendicular to) with respect to the main scanning direction, and thereby the high density nozzle head is formed in the present embodiment. In this matrix arrangement, the nozzles 551 can be regarded to be equivalent to those substantially arranged linearly at a fixed pitch $P=L_s/\tan\theta$ along the main scanning direction, where $L_s$ is a distance between the nozzles adjacent in the sub-scanning direction.

In implementing the present invention, the mode of arrangement of the nozzles 551 in the head 550 is not limited to the embodiments in the drawings, and various nozzle arrangement structures can be employed. For example, instead of the matrix arrangement as described in FIGS. 24A and 24B, it is also possible to use a V-shaped nozzle arrangement, or an undulating nozzle arrangement, such as zigzag configuration (W-shape arrangement), which repeats units of V-shaped nozzle arrangements.

The devices which generate pressure (ejection energy) applied to eject droplets from the nozzles in the inkjet head are not limited to the piezo-actuator (piezoelectric elements), and can employ various pressure generation devices (energy generation devices), such as heaters in a thermal system (which uses the pressure resulting from film boiling by the heat of the heaters to eject ink) and various actuators in other systems. According to the ejection system employed in the head, the corresponding energy generation devices are arranged in the flow channel structure body.

Mode of Head Bar in which a Plurality of Head Modules are Joined Together

As shown in the example in FIG. 25A, if one long head is composed by aligning a plurality of head modules each having a two-dimensional nozzle arrangement in a staggered configuration, then there are similar problems of vibration non-uniformity in the y-offset adjacent nozzle pairs which span between different head modules, as well as the y-offset adjacent nozzle pairs in the same head module, and these problems can be resolved by similar means.

Figure 27:
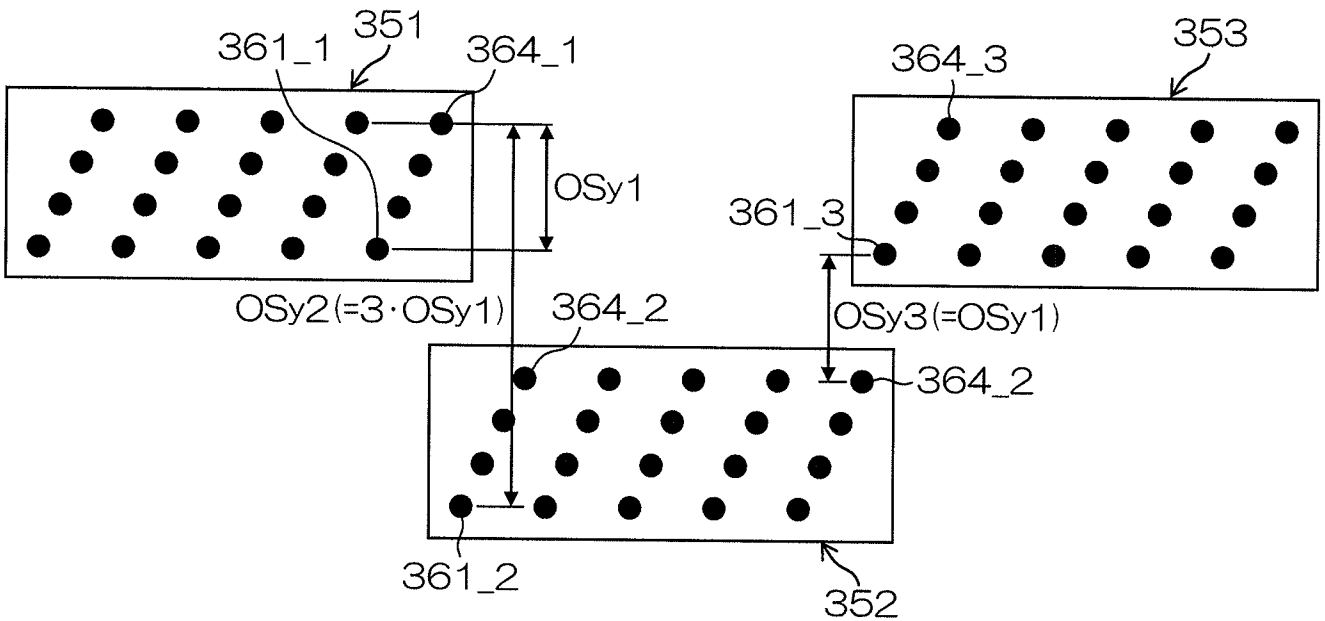
FIG. 27 is an illustrative diagram of the amount of offset of a y-offset adjacent nozzle pair which spans between different head modules.

FIG. 27 shows a schematic drawing of a staggered matrix head. FIG. 27 shows an example where three head modules 351, 352, 353 are arranged in a staggered configuration. The maximum value of the offset amount of the y-offset adjacent nozzle pairs within each of the head modules 351, 352, 353 is taken as OSy1. Here, the offset amount of the y-offset adjacent nozzle pair comprising a nozzle 361_i (where I=1, 2, 3) of the first row (bottommost row) in the module and a nozzle 364_i of the fourth row (uppermost row) is OSy1.

Furthermore, the offset amount of a y-offset adjacent nozzle pair which spans between different head modules 351 and 352 located in a separated fashion in the y direction (nozzle 364_1 and nozzle 361_2) is OSy2, and the offset amount of a y-offset adjacent nozzle pair (nozzle 364_2 and nozzle 361_3) which spans between the head modules 352 and 353 is OSy3.

OSy1 is designed so as to satisfy Relationship 1', Relationship 2' or Relationship 3', and OSy2 and OSy3 are each designed to be an integral multiple of OSy1. By means of a composition of this kind, all of OSy1, OSy2 and OSy3 satisfy Relationship 1', Relationship 2' or Relationship 3'. FIG. 27 shows an example where OSy2=3×OSy1, and OSy3=OSy1, but the numerical value of the magnification rate is not limited in particular.

By means of a composition of this kind, it is possible also to suppress vibration non-uniformity in a y-offset adjacent nozzle pair which spans between head modules. The mode of arrangement of the head modules is not limited to a staggered arrangement, and it is also possible to employ a similar device to that described above, in a mode where modules are situated at different positions in the y direction.

The example shown in FIG. 27 is a case where each of OSy1, OSy2 and OSy3 satisfy Relationship 1', Relationship 2' or Relationship 3', but if the offset amount (OSy1) of the y-offset adjacent nozzle pairs within a head module is small, Relationship 1', Relationship 2' or Relationship 3' may be satisfied only in respect of the offset amount between head modules (OSy2, OSy3).

Figure 28:
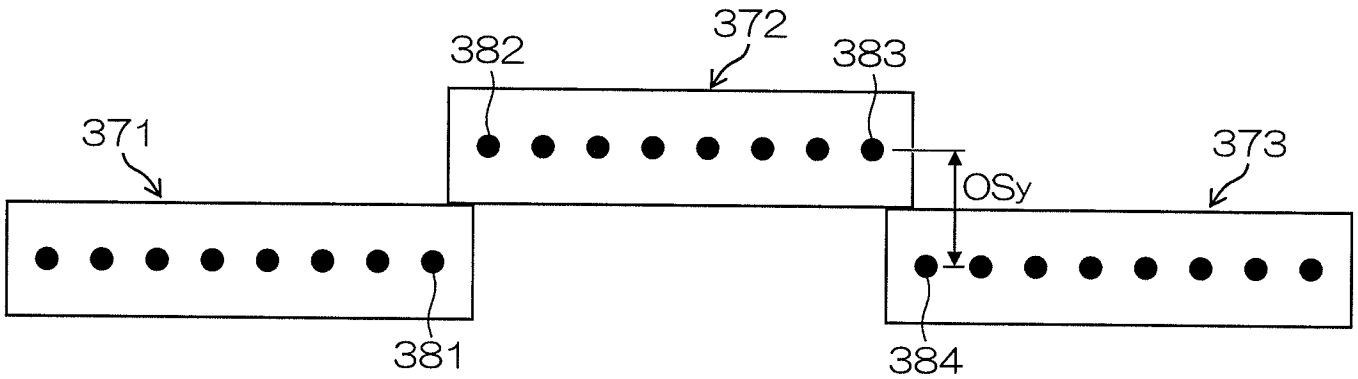
FIG. 28 is an illustrative diagram of a line head in which head modules having a one-dimensional nozzle arrangement are joined together in a staggered configuration.

Bar Head in which Head Modules Having a One-Dimensional Nozzle Arrangement are Arranged In a Staggered Matrix Configuration FIG. 28 is a schematic drawing showing a further example of the composition of a staggered matrix head. Dark/light non-uniformity (vibration non-uniformity) which is dependent on the y-direction spatial distance (y-direction offset amount OSy) between nozzles in the module joint section (nozzle joint section) may also occur in a line head in which head modules 371, 372, 373 having a one-dimensional nozzle arrangement are arranged in a staggered configuration as shown in FIG. 28. Therefore, a device similar to that described above can be used as a device for reducing vibration non-uniformity which is dependent on the offset amount OSy of a y-offset adjacent nozzle pair which spans between head modules (in FIG. 28, a nozzle pair comprising nozzle 381 and nozzle 382, and a nozzle pair comprising nozzle 383 and nozzle 384), and on the relative vibration frequency and the paper conveyance speed.

Recording Medium (Image Formation Medium)

In implementing the present invention, there are no particular restrictions on the material or shape, or other features, of the recording medium, and it is possible to employ various different media, irrespective of their material or shape, such as continuous paper, cut paper, seal paper, OHP sheets or other resin sheets, film, cloth, a printed substrate on which a wiring pattern, or the like, is formed, or a rubber sheet.

Modification Example

In the embodiments described above, an inkjet recording apparatus which conveys paper by drum conveyance is described by way of an example, but the paper conveyance device is not limited to this. For example, the present invention can also be applied similarly to an inkjet recording apparatus which uses belt conveyance or an inkjet recording apparatus which uses roller conveyance. In this case, an axle fixing structure similar to that of the image formation drum is adopted for the rollers about which the belt is wrapped, and the paper conveyance rollers.

Application Of The Present Invention

In the embodiments described above, application to an inkjet recording apparatus for graphic printing has been described, but the scope of application of the present invention is not limited to this. For example, the present invention can be applied widely to inkjet image forming apparatuses for obtaining various shapes or patterns using liquid function material, such as a wire recording apparatus which forms an image of a wire pattern for an electronic circuit, manufacturing apparatuses for various devices, a resist printing apparatus which uses resin liquid as a functional liquid for ejection, a color filter manufacturing apparatus, a fine structure forming apparatus for forming a fine structure using a material for material deposition, and the like.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An image forming apparatus comprising:

a liquid ejection head having an ejection surface in which a plurality of nozzles that eject liquid droplets are arranged two-dimensionally;

a conveyance device which conveys a recording medium on which the liquid droplets ejected from the plurality of nozzles of the liquid ejection head are deposited;

a main body frame which supports the conveyance device;

a head movement device which supports the liquid ejection head movably with respect to the main body frame; and a head fixing device which fixes the movable liquid ejection head to the main body frame at a position for droplet ejection onto the recording medium, wherein:

the head fixing device has a pressure application device for head fixing which impels the liquid ejection head in a width direction of the recording medium which is perpendicular to a conveyance direction in which the conveyance device conveys the recording medium, and wherein a spring constant of the pressure application device for head fixing and a mass of the liquid ejection head are set so that a resonance ($f_1$) satisfies formula (1) below:

$$f_1=(2\pi)^{-1}\times(k_1/m_1)^{1/2} \quad (1)$$

where $f_1$ is the resonance frequency, $k_1$ is the spring constant of the pressure application device for head fixing, $m_1$ is the mass of the liquid ejection head;

wherein the resonance frequency ($f_1$) is different from a component of a vibration pitch which is dependent on a spatial distance in the conveyance direction between a pair of nozzles which correspond to a joint section of a nozzle alignment forming adjacent dots in the width direction on the recording medium, of distances between nozzles in the conveyance direction in nozzle arrangement of the liquid ejection head, a relative vibration in the width direction between the conveyance device and the liquid ejection head during conveyance of the recording medium, and a conveyance speed at which the conveyance device conveys the recording medium, and wherein a condition represented by formula (2) below is met:

$$|\sin\{\pi \cdot OSy \cdot fv/vp\}| \leq 1/4 \quad (2)$$

where OSy is the spatial distance, fv is the relative vibration frequency, and vp is the conveyance speed.

2. The image forming apparatus as defined in claim 1, further comprising:

an elevator device which moves the liquid ejection head to the position for droplet ejection where the liquid ejection head is moved closely to the conveyance device, and to a withdrawn position where the liquid ejection head is moved further away from the conveyance device than in the position for droplet ejection; and a cam mechanism which pushes the liquid ejection head in the width direction in coordination with a movement of the liquid ejection head to be closer to the conveyance device by the elevator device, and which releases pushing of the liquid ejection head in the width direction in coordination with a movement of the liquid ejection head to be away from the position for droplet ejection by the elevator device.

3. The image forming apparatus as defined in claim 2, wherein the cam mechanism includes:

an inclined cam surface provided on a side surface section of the liquid ejection head; and a rotating body which is provided on the main body frame and which is able to perform following rotation while abutting against the inclined cam surface.

4. The image forming apparatus as defined in claim 1, wherein:

a drum or roller is used as the conveyance device, and the image forming apparatus further comprises a conveyance unit fixing device which applies pressure in an axial direction of the drum or roller in such a manner that the drum or roller is fixed to the main body frame.

5. The image forming apparatus as defined in claim 4, wherein the conveyance unit fixing device has a pressure application device for conveyance unit fixing which impels the drum or roller towards the main body frame in the axial direction.

6. The image forming apparatus as defined in claim 5, wherein a spring constant of the pressure application device for conveyance unit fixing and a mass of the drum or roller are set so that a resonance frequency ($f_2$)satisfies formula (3) below:

$$f_2=(2\pi)^{-1}\times(k_2/m_2)^{1/2} \quad (3)$$

where $f_2$ is the resonance , $k_2$ is the spring constant of the pressure application device for conveyance unit fixing, $m_2$ is the mass of the drum or roller;

wherein the resonance frequency ($f_2$)different from the component of the vibration pitch.

7. The image forming apparatus as defined in claim 1, wherein:

the head movement device includes:

a carriage which is provided movably with respect to the main body frame;

a mounting platform which is provided on the carriage and on which the liquid ejection head is mounted; and a guide rail installed on the main body frame, wherein:

the carriage is movably guided along the guide rail in such a manner that the liquid ejection head is able to be moved between a first position where the conveyance device is opposed to the liquid ejection head and a second position outside a conveyance region where the recording medium is conveyed by the conveyance device, and the image forming apparatus further comprises a carriage fixing device which fixes the carriage to the main body frame in the first position.

8. The image forming apparatus as defined in claim 7, wherein:

an electromagnet and a fixed member which is magnetically attached to the electromagnet are used as the carriage fixing device, and one of the electromagnet and the fixed member is provided on the main body frame and the other one of the electromagnet and the fixed member is provided on the carriage.

9. The image forming apparatus as defined in claim 7, further comprising a maintenance device which performs maintenance of the liquid ejection head at the second position.

10. The image forming apparatus as defined in claim 1, wherein:

the liquid ejection head is a line head which is long in the width direction of the recording medium, and image formation based on a single pass method is carried out in such a manner that an image is formed on the recording medium by causing just one relative movement in the conveyance direction between the recording medium and the liquid ejection head.

11. An image forming apparatus comprising:

a liquid ejection head in which a plurality of head modules each having a plurality of nozzles that eject liquid droplets are arranged in a staggered configuration;

a conveyance device which conveys a recording medium on which the liquid droplets ejected from the plurality of nozzles of the liquid ejection head are deposited;

a main body frame which supports the conveyance device;

a head movement device which supports the liquid ejection head movably with respect to the main body frame; and a head fixing device which fixes the movable liquid ejection head to the main body frame at a position for droplet ejection onto the recording medium, wherein:

the head fixing device has a pressure application device for head fixing which impels the liquid ejection head in a width direction of the recording medium which is perpendicular to a conveyance direction in which the conveyance device conveys the recording medium, and wherein a spring constant of the pressure application device for head fixing and a mass of the liquid ejection head are set so that a resonance ($f_1$) satisfies formula (1) below:

$$f_1=(2\pi)^{-1}\times(k_1/m_1)^{1/2} \quad (1)$$

where $f_1$ is the resonance , $k_1$ is the spring constant of the pressure application device for head fixing, $m_1$ is the mass of the liquid ejection head;

wherein the resonance ($f_1$) is different from a component of a vibration pitch which is dependent on a spatial distance in the conveyance direction between a pair of nozzles which correspond to a module joint section of a nozzle alignment forming adjacent dots in the width direction on the recording medium, of distances between nozzles in the conveyance direction in nozzle arrangement of the liquid ejection head, a relative vibration frequency in the width direction between the conveyance device and the liquid ejection head during conveyance of the recording medium, and a conveyance speed at which the conveyance device conveys the recording medium, and wherein a condition represented by formula (2) below is met:

$$|\sin\{\pi \cdot OSy \cdot fv/vp\}| \leq 1/4 \quad (2)$$

where OSy is the spatial distance, fv is the relative vibration frequency, and vp is the conveyance speed.

12. The image forming apparatus as defined in claim 11, further comprising:

an elevator device which moves the liquid ejection head to the position for droplet ejection where the liquid ejection head is moved closely to the conveyance device, and to a withdrawn position where the liquid ejection head is moved further away from the conveyance device than in the position for droplet ejection; and a cam mechanism which pushes the liquid ejection head in the width direction in coordination with a movement of the liquid ejection head to be closer to the conveyance device by the elevator device, and which releases pushing of the liquid ejection head in the width direction in coordination with a movement of the liquid ejection head to be away from the position for droplet ejection by the elevator device.

13. The image forming apparatus as defined in claim 12, wherein the cam mechanism includes:

an inclined cam surface provided on a side surface section of the liquid ejection head; and a rotating body which is provided on the main body frame and which is able to perform following rotation while abutting against the inclined cam surface.

14. The image forming apparatus as defined in claim 11, wherein:

a drum or roller is used as the conveyance device, and the image forming apparatus further comprises a conveyance unit fixing device which applies pressure in an axial direction of the drum or roller in such a manner that the drum or roller is fixed to the main body frame.

15. The image forming apparatus as defined in claim 14, wherein the conveyance unit fixing device has a pressure application device for conveyance unit fixing which impels the drum or roller towards the main body frame in the axial direction.

16. The image forming apparatus as defined in claim 15, wherein a spring constant of the pressure application device for conveyance unit fixing and a mass of the drum or roller are set so that a resonance ($f_2$) satisfies formula (3) below:

$$f_2 = (2\pi)^{-1} \times (k_2/m_2)^{1/2} \quad (3)$$

where $f_2$ is the resonance , $k_2$ is the spring constant of the pressure application device for conveyance unit fixing, $m_2$ is the mass of the drum or roller;

wherein the resonance ($f_2$) is different from the component of the vibration pitch.

17. The image forming apparatus as defined in claim 11, wherein:

the head movement device includes:

a carriage which is provided movably with respect to the main body frame;

a mounting platform which is provided on the carriage and on which the liquid ejection head is mounted; and a guide rail installed on the main body frame, wherein:

the carriage is movably guided along the guide rail in such a manner that the liquid ejection head is able to be moved between a first position where the conveyance device is opposed to the liquid ejection head and a second position outside a conveyance region where the recording medium is conveyed by the conveyance device, and the image forming apparatus further comprises a carriage fixing device which fixes the carriage to the main body frame in the first position.

18. The image forming apparatus as defined in claim 17, wherein:

an electromagnet and a fixed member which is magnetically attached to the electromagnet are used as the carriage fixing device, and one of the electromagnet and the fixed member is provided on the main body frame and the other one of the electromagnet and the fixed member is provided on the carriage.

19. The image forming apparatus as defined in claim 17, further comprising a maintenance device which performs maintenance of the liquid ejection head at the second position.

20. The image forming apparatus as defined in claim 11, wherein:

the liquid ejection head is a line head which is long in the width direction of the recording medium, and image formation based on a single pass method is carried out in such a manner that an image is formed on the recording medium by causing just one relative movement in the conveyance direction between the recording medium and the liquid ejection head.

* * * * *